US008925119B2

(12) United States Patent
Burt

(10) Patent No.: US 8,925,119 B2
(45) Date of Patent: Jan. 6, 2015

(54) IN LAVATORY DISPENSING DEVICES

(75) Inventor: Diane Joyce Burt, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 390 days.

(21) Appl. No.: 13/375,806

(22) PCT Filed: May 26, 2010

(86) PCT No.: PCT/EP2010/057264

§ 371 (c)(1),
(2), (4) Date: Feb. 15, 2012

(87) PCT Pub. No.: WO2010/139584

PCT Pub. Date: Dec. 9, 2010

(65) Prior Publication Data

US 2012/0131739 A1 May 31, 2012

(30) Foreign Application Priority Data

Jun. 4, 2009 (GB) ..... 0909634.8

(51) Int. Cl.
*E03D 9/00* (2006.01)
*E03D 9/03* (2006.01)
*E03D 9/02* (2006.01)

(52) U.S. Cl.
CPC ..... *E03D 9/037* (2013.01); *E03D 2009/024* (2013.01)
USPC ..... 4/225.1

(58) Field of Classification Search
USPC ..... 4/222, 223, 224, 225.1, 226.1, 4/227.1–227.7
See application file for complete search history.

(56) References Cited

U.S. PATENT DOCUMENTS

| | | | | | |
|---|---|---|---|---|---|
| 650,161 | A | * | 5/1900 | Williams | 4/227.7 |
| 969,729 | A | * | 9/1910 | Smith | 4/227.7 |
| 1,728,737 | A | * | 9/1929 | Stoner | 4/227.5 |
| 2,045,473 | A | * | 6/1936 | Keillor | 4/225.1 |
| 2,479,842 | A | * | 8/1949 | Kirwan | 4/224 |
| 2,993,214 | A | * | 7/1961 | Franco | 4/225.1 |
| 3,105,245 | A | | 10/1963 | Finkbiner | |
| 4,429,423 | A | * | 2/1984 | Syrenne | 4/225.1 |
| 5,042,095 | A | | 8/1991 | Schoepe et al. | |
| 5,387,249 | A | * | 2/1995 | Wiecorek | 4/225.1 |
| 5,745,928 | A | * | 5/1998 | Armanno, Sr. | 4/225.1 |
| 5,881,396 | A | | 3/1999 | Rivera | |
| 6,240,572 | B1 | * | 6/2001 | Van Der Gaag et al. | 4/225.1 |
| 6,341,385 | B1 | | 1/2002 | Downes | |

FOREIGN PATENT DOCUMENTS

WO 2010007337 A1 1/2010

OTHER PUBLICATIONS

International Search Report and Written Opinion for application PCT/EP2010/057264 dated Sep. 7, 2010.
Combined Search Report and Written Opinion for priority application GB0909634.8 dated Oct. 12, 2009.

* cited by examiner

*Primary Examiner* — Huyen Le
*Assistant Examiner* — Erin Deery
(74) *Attorney, Agent, or Firm* — Norris McLaughlin & Marcus PA

(57) ABSTRACT

The present invention relates to improved toilet dispensing devices for use in conjunction with a sanitary appliance, particularly a toilet. The toilet dispensing devices devices are adapted to be used in the cistern or tank of a toilet or other lavatory device.

17 Claims, 9 Drawing Sheets

IN LAVATORY DISPENSING DEVICES

This is an application filed under 35 USC 371 of PCT/EP2010/057264.

The present invention relates to improved lavatory dispensing devices. More particularly the present invention relates to improved lavatory dispensing devices which are useful in conjunction with a toilet cistern, as well as a method for delivering a treatment composition to a toilet bowl in toilets provided with a cistern. The said treatment composition contains one or more chemical constituents e.g., coloring agents, cleaning agents, disinfecting agents, anti-lime scale agents which are provided with the dispensing devices. The treatment composition is formed by water contacting the chemical constituents of the device coming into contact with the one or more chemical constituents, which are released into the bowl of the toilet.

Since the advent of sanitary appliances and in particular modern flush toilets, there has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls.

One common approach known to the art is to provide a device which is at least immersed within the cistern or tank of a toilet, which may be either placed wholly within the interior of the toilet such as by placement at the bottom of a toilet tank so that the entire device is wholly immersed in water when the tank is full, or is at least partially immersed within the water present in a toilet tank, such as wherein such a device is suspended from a part of the toilet tank, such as a lip or rim of the tank. Such are generally referred to as ITC devices.

A shortcoming of such ITC devices known to the art resides in the fact that they are frequently totally immersed in the water present in the cistern. Two technical shortcomings frequently result from such immersed ITCs. First, the compositions of an ITC are difficult to formulate as many constituents which are desirably present in such lavatory blocks such as many surfactants, particularly higher foaming surfactants including anionic surfactants, are also water soluble or water dispersible. Thus when a solid lavatory block containing surfactants, particularly higher foaming surfactants are immersed in water for a period of time, often the presence of such surfactants undesirably softens the immersed block and reduces the performance characteristics of the block over time, and may even lead to diminish lifespan due to premature dissolution of the solid lavatory block. While this problem may be addressed by the use of different surfactants which are more hydrophobic, such more hydrophobic surfactants are also recognized in the art as having reduced cleaning and/or foaming. Further, the compositions of an ITC block may include constituents such as an active source of oxygen, such as an oxidant compound or composition such as bleach, the presence of the oxidant in the standing water of the toilet cistern frequently chemically attacks any metal parts which are also present in the standing water of the cistern and may induce corrosion, and premature failure of any mechanism which comprises such metal parts. Prominently, flushing mechanisms for releasing or dispensing water to be flushed from the cistern to the toilet, and/or cistern refill devices for refilling the toilet cistern following a flush cycle come into consideration. While this problem may be addressed by the inclusion of corrosion inhibiting compounds or compositions in lavatory block composition adapted to be used in an ITC, or as an ITC, such increases the complexity of such a lavatory block formulation as well as its cost.

A further technical problem in the art resides in the fact that during the flush cycle of a toilet, the quantity of water present in the cistern is released into the toilet bowl via one or more fluid passages which provide a fluid conduit between, which while effective in providing a treatment composition such as it intended to provide a general cleaning and/or sanitizing/disinfecting benefit to the toilet bowl consequence from the contact of the water provided by the flush cycle, this lime of water containing such a treatment composition or forming a treatment composition is essentially evacuated at the conclusion of the flush cycle and passes to the drain lines, with little if any essentially remaining within the interior of the toilet bowl. Add her to the conclusion of the flush cycle, and during the refilling of the cistern, typical devices provide water to fill the bottom of the toilet bowl, also referred to as the "sump" was a quantity of fresh water which supplied via a refill device. Such a refill device is well known in the art comment typically resides within the interior of the cistern. The refill device typically includes a float mechanism which rises or falls with the level of water within the cistern, which float mechanism is usually affixed via an intermediate linkage to a cutoff for a fill valve. When the cistern is emptied of its contents, the float drops, actuating the refill device such that a major proportion of water from a supply line is directed to the interior of the cistern, while at a secondary minor proportion of the water being supplied it is passed through an overflow conduit, said overflow tube having one and inserted into the standpipe of a flush valve, also known as the overflow tube. This secondary minor proportion of water is supplied to the interior of the standpipe of the flush valve, and passes through the base of the flush valve and into the toilet bowl. As the refill device operates, water is supplied to the interior of the cistern as well as to the overflow conduit and into the standpipe of the flush valve, during which process, referred to as a "refill cycle", the rising level of water within the cistern closes the float mechanism to rise due to its buoyancy with respect to this water, and ultimately when an appropriate level of water is supplied to the cistern, the cutoff for the fill valve operates and terminates the flow of water to both the interior of the cistern, as well as through the overflow tube. Typically, the appropriate level of water is a sufficient volume of water wherein the top level or top surface of the water within the cistern is below the open end at the top of the overflow tube. During this process, it is to be appreciated in that a major proportion of the water being supplied via the overflow conduit and downwardly through the overflow tube is retained within the sump of the toilet bowl.

U.S. Pat. No. 6,240,572 provides a device useful in the sanitization of a toilet. As it is seen from that document, the main body of said device is substantially cylindrical and comprises a plurality of stacked sanitizing tablets therein. Further, the inlet to the main body is at the base thereof, and as can be seen from the figure this impedes the flow of water being provided from a conduit which must then pass about the peripheral margins of the stacked sanitizing tablets and operate against the force of gravity. Thus the interior of the device is pressurized during the flow of water through the main body of the device else it would not flow upwardly. As a visible from the depiction, the stacked sanitizing tablets have essentially the same cross-sectional diameter as the interior cross-sectional diameter of the substantially cylindrical main body of said device, and it is foreseen that such will deleteriously affect the fluid flow of water being supplied to the interior of said device. It is expected that any erosion of said stack of sanitizing tablets will occur beginning with the base tablet and as the stack of sanitizing tablets are sequentially eroded, the next vertically positioned tablet will fall downwards to the bottom of the device and continue to block the inlet to the main body. Such impedes the fluid flow passing through this prior art device in an unsatisfactory manner, and requires pressurization.

Thus, there exists a real and urgent need in the art for improved lavatory dispensing devices which are particularly well adapted to be positioned in a toilet cistern, viz., an ITC device, as well as a method of making such an ITC device as well as methods for the treatment of a toilet bowl via the use of such an improved ITC device.

The present invention, in its various aspects, provides a lavatory dispensing device useful for the delivery of at least one treatment composition, preferably a cleaning composition and/or a sanitizing composition to a sanitary appliance, e.g. a toilet bowl. The device is used as an ITC type device.

According to a first aspect of the invention there is provided an improved lavatory dispensing device comprising a treatment composition adapted to be mounted on the overflow tube of a toilet or other lavatory appliance.

In a second aspect of the invention there is provided a process for treating a sanitary appliance, especially a toilet, with the improved lavatory dispensing device described herein.

In a third aspect there is provided a method for the manufacture of the improved lavatory dispensing devices described herein.

These and other aspects of the invention will be more evident from a reading of the following specification.

FIG. 1 depicts in a cross sectional view a toilet cistern (toilet tank), also depicting a dispensing device according to the invention mounted therein.

FIGS. 2A, 2B, 2C and 2D each depict a view of a dispensing device in a specific state of operation relative to the operation of the toilet.

Figure 10A:
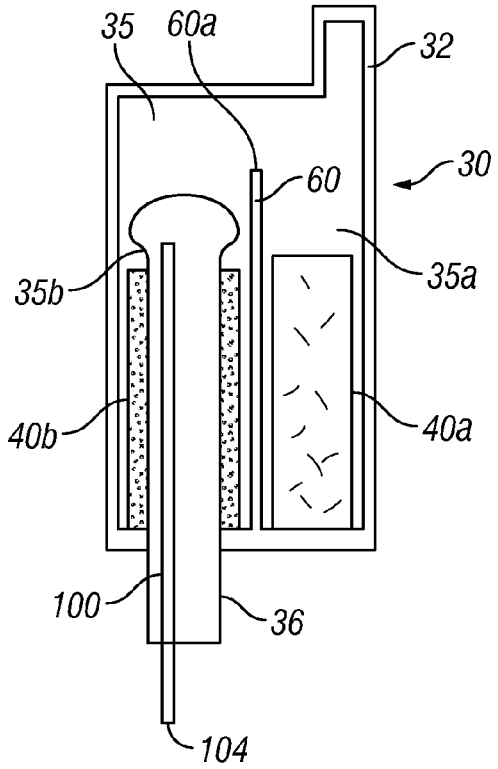
Figure 10B:
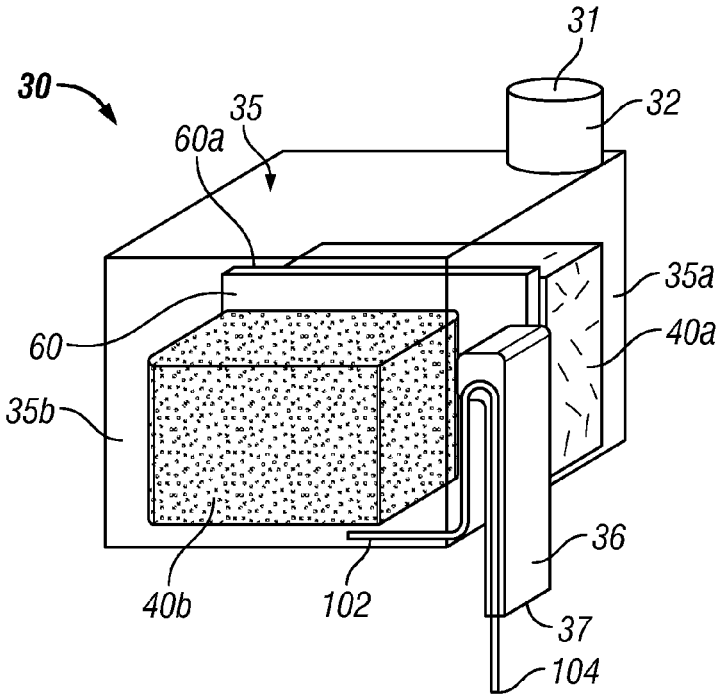

FIGS. 10A and 10B two different views of a yet further embodiment of a dispensing device.

Figure 11A:
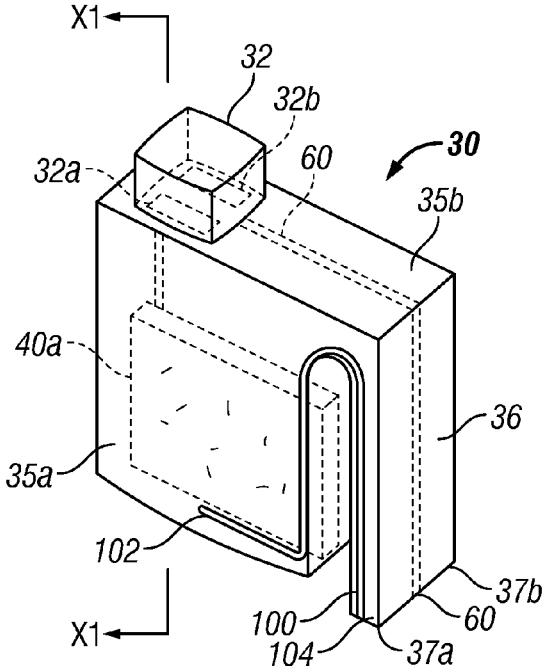
Figure 11B:
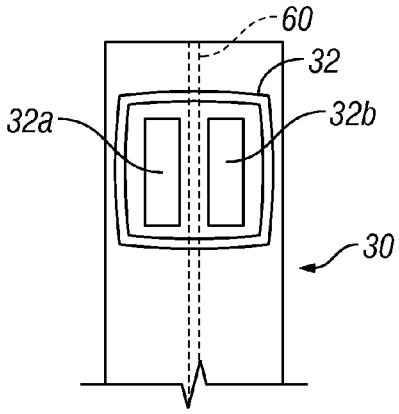
Figure 11C:
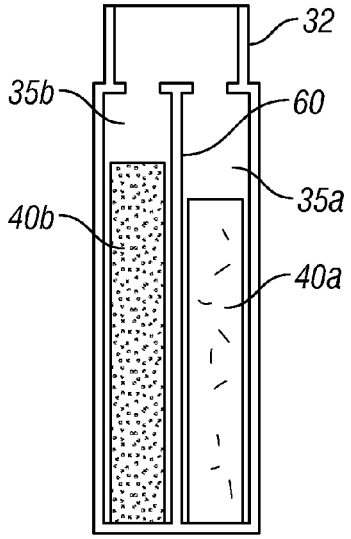

FIGS. 11A, 11B and 11C depict three different views of a further embodiment of a dispensing device.

Figure 12:
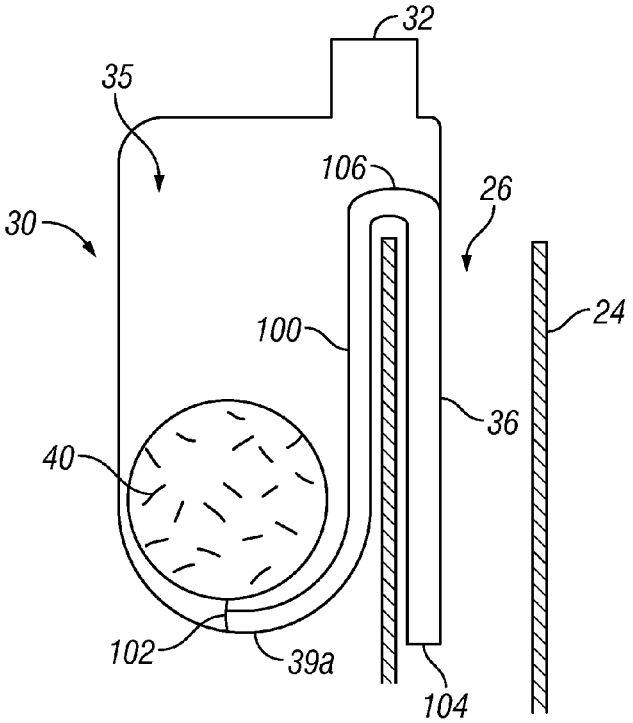

FIG. 12 illustrates a cross-sectional view of a still further embodiment of a dispensing device.

Broadly defined, the present invention provides a non-pressurizable lavatory dispensing device comprising a hollow body having an inlet located along or at the top surface of the device which inlet is open to the ambient environment of the lavatory appliance, viz., toilet, in which it is installed, and an outlet also open to the ambient environment of the lavatory appliance, viz., toilet, in which it is installed, said hollow body defining an interior hollow cavity which is adapted to contain a quantity, e.g, a mass, of at least one chemical treatment composition as well as a quantity of a liquid, especially water, provided to the interior of said hollow body via the inlet, wherein the outlet of the device is adapted to be inserted at least partially into the interior of an overflow tube present in the cistern of a toilet (or other sanitary appliance) and whereby the said hollow body is suspended downwardly from the top open end of the overflow tube, and wherein the device includes a siphon means extending between the interior of the hollow body, and the exterior of the device, which siphon is adapted to withdraw liquid present within the interior of the hollow body therefrom and transfer said liquid to the exterior of the device preferably, to the exterior of the device via the outlet thereof or to the interior of the overflow tube. In certain preferred embodiments the siphon means is distinct from the outlet of the device, while in other preferred embodiments the outlet of the device concurrently operates as the siphon means.

In particularly preferred embodiments, the lavatory dispensing device is of a sealed construction and cannot be opened by a consumer or other user once the lavatory dispensing device is assembled, and thus excludes an element which provides for easy access into the interior of the lavatory dispensing device, particularly to the hollow body. The interior cavity is in fluid communication with both the inlet, and with the outlet. In certain preferred embodiments, the inlet and the outlet are both located at one side of the hollow body with the inlet being separated from the outlet by a flow diverter means such as an internal diverter plate which directs the flow of any liquid being supplied via the inlet into the hollow cavity which contains the chemical treatment composition. In certain preferred embodiments, the inlet and/or the outlet are unobstructed by the chemical treatment composition present within the hollow body, and in particularly preferred embodiments both the inlet and the outlets are unobstructed by the chemical treatment composition present within the interior, especially within the interior cavity of the lavatory dispensing device. In preferred embodiments, the inlet of the device may form an upwardly directed tube or leg which provides for fluid communication between an open end of the inlet, with the hollow cavity in the interior of the device, and the outlet of the device may form a downwardly directed tube or leg which provides for fluid communication between the hollow cavity in the interior of the device, and an open end of the outlet. In a preferred embodiment, the inlet is disposed or positioned vertically above the outlet, such that the inlet and the outlet may be considered to have a center line or center axis which is along the flow direction of the water passing therethrough these respective elements; in certain embodiments the center line or center axis of the inlet coincides with the center line or center axis of the outlet, while in certain further embodiments the center line or center axis of the inlet are parallel to but non-coincident with the center line or center axis of the outlet, while in still further embodiments the center line or center axis of the inlet is angled with respect to the center line or center axis of the outlet, wherein such angle is preferably not more than 90°, and in order of increasing preference is not more than 85°, 80°, 70°, 60°, 50°, 45°, 40°, 35°, 30°, 25°, 20°, 15°, 10°, and 5°.

The lavatory dispensing device of the invention includes a siphon means effective for removing or transferring a quantity of a lavatory treatment composition present within the interior cavity to the exterior of the device. Advantageously the siphon means extends between the interior of the hollow body, and the exterior of the device which siphon is adapted to withdraw liquid, e.g. water or a lavatory treatment composition formed within the device and transfer said liquid to the exterior of the device. In certain preferred embodiments an inlet end of the siphon is positioned within, or alternately is in fluid communication with the interior cavity, especially the hollow body of the device which interior cavity contains the chemical treatment composition, and an outlet end of the siphon is present within, or extends from the outlet of the device. In a further preferred embodiment, an inlet end of the siphon is positioned within, or alternately is in fluid communication with the interior cavity, especially the hollow body of the device which interior cavity contains the chemical treatment composition, and an outlet end of the siphon is present at a position exterior of the device, but not within or extending from the outlet of the device. In such an embodiment, the siphon is useful in transferring a liquid from within the interior cavity of the device outwardly of the device however avoiding the outlet thereof. This latter embodiment permits for the transfer of liquid from within the interior cavity to location different than the outlet, e.g., to a volume of water present within a toilet cistern. Alternately the latter embodiment permits for the transfer of liquid from within the interior cavity to location different than the outlet, e.g., to the interior of the overflow tube but bypassing the outlet of the device, or alternately, to the interior of the toilet tank. In a still further preferred embodiment the device is configured such that the outlet part of the device forms part of the siphon means, such that the need for a discrete or separate siphon means and a discrete or separate outlet means is not needed, but rather part of the outlet means, or the outlet means itself in conjunction with a suitable configured device operates as the siphon means.

The siphon means may be a discrete part or element which is not integral to the construction of the device, e.g., is a pipe, tube, vessel or other fluid conduit which may be separately fabricated and later introduced into or upon the device during the assembly thereof, or alternately the siphon may be an integral part or element of the device, e.g., is molded as part of the device and forms an integral part thereof. The siphon means may be of any of a number of configurations which is found to be effective, and may have any useful cross-sectional profile. The rate of flow of a liquid through the siphon can be influenced or controlled by the cross-sectional profile, e.g., diameter or cross-sectional area transverse to the direction of liquid flow passing through the siphon means.

Two or more siphons may also be present in the device according to the invention as siphon means, which may be used to transfer liquid from the interior of the device to the exterior of the device, which may be to two or more different locations or points within the lavatory appliance, but which may also be to the same location or point within the lavatory appliance, e.g., to the tank, to the interior of the overflow tube, or other point or location.

The inclusion of siphon means within the device of the invention provides several important technical advantages. The siphon means permits for the use of chemical treatment compositions in the device which may be deleteriously affected by prolonged immersion in a liquid, e.g. water. By "deleteriously affected" in this context is that the chemical treatment composition may be unduly softened, or too rapidly or undesirably rapidly dissolved by liquid, e.g., water, present within the device. Such softening or too rapid dissolution may undesirably shorten the useful service life of the device when used. Such softening or too rapid dissolution also constrains the choice of chemical treatment composition which might otherwise be contemplated for use with the device of the invention. Such is relevant when a single chemical treatment composition is present within the device, and is perhaps more relevant when at least two chemical treatment compositions are present in the device, one of which is more liquid soluble (e.g., aqueous soluble) than at least a further different chemical treatment composition. In the case of such a plurality of different chemical treatment compositions being present in the device, having different liquid solubilities, it is frequently desired and may be preferred that the most liquid soluble, e.g., water soluble, chemical treatment composition be consumed at about the same time or at about that at least one further chemical treatment composition in the device is consumed by dissolution. In this manner, during the majority of the useful service life of the device, the formation of a lavatory treatment composition will comprise materials obtained from both the at least two chemical treatment compositions, namely the more liquid soluble, as well as one or more further less soluble chemical treatment composition.

During normal use of a device according to the invention which contains at least two different chemical treatment compositions having different liquid solubilities, a first chemical treatment composition having a first rate of liquid solubility "$R_1$", e.g., aqueous solubility, and a second chemical treatment composition having a second rate of liquid solubility "$R_2$", e.g., aqueous solubility, desirably the difference between $R_1$ and $R_2$ does not exceed 250%, and in order of increasing preference does not exceed: 225%, 200%, 180%, 160%, 150%, 140%, 120%, 100%, 90%, 80%, 75%, 70%, 60%, 50%, 40%, 30%, 25%, 20%, 10%, 5%, and most preferably are about, or, 0%. These rates of liquid solubility may be controlled by the selection of chemical constituents used to form a specific chemical treatment composition, and/or its size, mass or configuration, and/or the placement of the chemical treatment composition within the hollow cavity in the interior of the device. Wherein the device includes a plurality of chemical treatment compositions having different solubilities, preferably the chemical treatment composition being most soluble within the liquid, e.g. water, may be assigned $R_1$, while the chemical treatment composition present being most soluble within the liquid, e.g. water, may be assigned $R_2$. In view of the foregoing, in certain preferred embodiments it is desirable from a consumer standpoint that where two or more chemical treatment compositions are used with the device, that they be consumer or exhausted at approximately the same time.

In certain and preferred embodiments of the lavatory dispensing device of the invention, said device may also include a flow diverter means such as an internal diverter plate which directs the flow of any liquid being supplied via the inlet into the hollow cavity which contains the chemical treatment composition. Such a flow diverter means is not essential in all embodiments of the device, but is conveniently included in this present within the interior of the device particularly wherein that the center line or center axis of the inlet coincides with the center line or center axis of the outlet, ask them in the absence of such a flow diverter means liquid, viz., water entering the device of the in liquid flowed directly downwardly and exit the device via the outlet, without coming into contact with the hollow cavity and the chemical treatment composition contained therein. The form of the flow diverter means can take any shape or configuration which is suitable to provide such an effect, and indeed many in certain embodiments be considered to form an integral part of the inlet part of the device. Conveniently, the flow diverter means is in the form of a flat or curved element such as a flat or curved plate which redirects the direction of flow of the liquid entering the device through the open end of the inlet such that it is forced to enter the hollow cavity prior to exiting the hollow cavity via the outlet of the device. A plurality of elements or parts may also be used as the flow diverter means. In such a manner, contact of the liquid entering the device with the chemical treatment composition can be reliably assured. A flow diverter means however can be omitted where the configuration of the devices such that the direction of liquid, viz. water entering the inlet is forced to pass through at least a portion of the hollow cavity prior to exiting via the outlet, such as wherein the center line or center axis of the inlet are non-coincident with the center line or center axis of the outlet.

The present inventors have also found that the hollow cavity of the lavatory dispensing device should have an adequate volume which is sufficient to contain within its interior both a chemical treatment composition as well as a sufficient quantity of a liquid, e.g., water, which is retained within the hollow cavity and in intimate contact with the chemical treatment composition during the flush cycle of the toilet. The intimate contact of the water in such a manner permits for the formation of a lavatory treatment composition which is formed by the dilution, dissolution, diffusion, elution and/or solubilization of at least one or more chemical compounds from the chemical treatment composition, or from the plurality of chemical treatment compositions, into the water present within the hollow cavity, particularly the water which passes through and/or is retained within the hollow cavity during the flush cycle of the toilet. Upon the actuation of the refill device of the lavatory appliance, a quantity of water is supplied to the interior of the lavatory dispensing device via its inlet, where said water flows into the hollow cavity and forms the lavatory treatment composition which can subsequently be delivered to the exterior of the device, such as through the outlet of the device and into the interior of the overflow tube, as well through the siphon means. Upon the cessation of the supply of water to the device of the invention, the siphon means operates to transfer or remove liquid, preferably the lavatory treatment composition from the interior of the device and transfer it outward from the device, e.g. outward through the outlet of the device and into the interior of the overflow tube, and/or from the interior of the device to the exterior of the device, e.g., into the liquid contained with the cistern of a toilet. The rate of the transfer of the liquid, preferably of the lavatory treatment composition, can be controlled by varying the size or dimensions of the siphon or siphons present as the siphon means, particularly by controlling the diameter or limiting at least a part of the cross-sectional area of the siphon means so to limit the flowrate of the liquid, especially a lavatory treatment composition passing therethrough.

The siphon means provides several important technical benefits to the device of the invention and to their mode of operation. A first technical benefit stems from the fact that following the cessation of the supply of water to the device of the invention, such as by the refill device, liquid present within the interior of the device, viz., the hollow cavity, may be withdrawn and transferred out of the device which permits for the chemical treatment composition to at least partially dry until the next flush cycle. Such permits for the use of chemical treatment compositions which might otherwise be considered unsuitable for use in the device if said chemical treatment compositions in a liquid such as water which would lead to premature softening or unduly quick dissolution of the chemical treatment composition. Such would be particularly true if the chemical treatment compositions were continuously immersed in a liquid, such as water. A second technical benefit realized from the use of the device containing a siphon means resides in the extended time interval during which a laboratory treatment composition can be delivered to a toilet bowl via the livery of the same through the interior of the overflow tube upon the cessation, or following the cessation of supply water to the device of the invention. Use of the device according to the invention, particularly when mounted upon an inlet of the overflow tube such as the top thereof, wherein the outlet of the device as well as the outlet of the siphon means are directed into the interior of the overflow tube permits for the extended delivery or prolonged delivery of the laboratory treatment composition during, and after the conclusion of the flush cycle. Namely, during the flush cycle, when the refill device delivers a liquid, water, via the inlet of the device into its interior, a laboratory treatment composition is formed due to the intimate contact, and at least partial dissolution of the chemical treatment composition into the liquid. During this part of the flush cycle, the pressure of the stream of water entering via the inlet forces the laboratory treatment composition out via the outlet of the device, as well as simultaneously filling the siphon means. Upon the termination or cessation of water supply to the device, the lavatory treatment composition present within the hollow cavity of the device is then transferred out from the device via the siphon action of the siphon means outward from the device and into the interior of the overflow tube. Appropriate selection of the configuration of the siphon means, as well as the volume of available liquid treatment composition present within the device upon the cessation of water supply from the refill device can be established in order to deliver a desired volume of liquid treatment composition from the device. For example, providing a wider diameter tube as the siphon means if a more rapid delivery rate is desired or, conversely, a narrower diameter tube as the siphon means if a prolonged delivery rate is desired. The advantage of a prolonged delivery rate is that, a greater amount of the liquid treatment composition can be delivered into the interior or the sump of the toilet bowl within which it would be retained prior to the next flush cycle, e.g. a prolonged delivery of the lavatory treatment composition.

Although the time interval during which a lavatory treatment composition may be delivered solely by a siphon means may vary, advantageously the device and siphon means is configured such that a lavatory treatment composition is delivered to the exterior of the device for at least 2 seconds, and in order of increasing preference 4, 5, 7, 10, 15, 20, 30, 40, 50, and at least 60 seconds following cessation of the release or delivery of a lavatory treatment composition via a device's outlet. In such a manner a prolonged or time delayed release of a lavatory treatment composition may occur. When the device is used in a toilet, such as described in preferred embodiments, preferably a lavatory treatment composition may be delivered solely by a siphon means following the conclusion of the refill cycle of a toilet.

Accordingly, according to certain particularly preferred embodiments, the siphon means present within, or as part of the device according to the invention operates to essentially drain all of the liquid (<90% volume, preferably 95% volume, but preferably yet more) or lavatory treatment composition present within the device from within the interior of the hollow cavity of the device, and deliver it to the exterior of the device. Such can be simply attained by ensuring that the outlet of the siphon means is at a horizontal level or point lower than the inlet of the siphon means. Preferably, such delivery of the liquid is directed into the interior of the overflow tube, but it is also contemplated that the liquid can be delivered elsewhere, such as to the interior of the tank or cistern. Such may be advantageous particularly where the lavatory treatment composition might include a visible indicator such as a dyestuff, or may include a suitable treatment agent which can be delivered into the cistern between flushes. For example, it may be advantageous to provide a small quantity of the laboratory treatment composition such as an antibacterial agent, e.g., a bleach, oxidizing agent, or quaternary ammonium compound in order to control the undesired growth of microorganisms within the tank, which may also be advantageous in reducing malodorous, etc. Thus, a device according to the invention can be configured whereby a chemical treatment composition is contained within the interior of the device, during the flush cycle a major volume of the lavatory treatment composition formed passes through the outlet of the device and downwardly through the overflow tube and into the sump of the toilet bowl, while a minor volume of the lavatory treatment composition he's delivered into the tank or cistern, particularly to the quantity of water contained therein.

Alternately, according to further preferred embodiments, the siphon means present within, or as part of the device according to the invention operates to drain some, but not all of the liquid, particularly the lavatory treatment composition, from within the interior of the hollow cavity of the device and deliver it to the exterior of the device, while at the same time allowing for the retention of a quantity of liquid within the interior of the device between flush cycles. This can be very simply achieved by ensuring that the outlet of the siphon means is at a horizontal level or point lower than the inlet of the siphon means, or the converse. Such a configuration ensures that some of the liquid present within the interior of the device is not drained or transferred out by the siphon means.

The interior cavity of the device, interchangeably referred to as the hollow cavity of the lavatory dispensing device should have an adequate volume which is sufficient to contain within its interior both a chemical treatment composition as well as a sufficient quantity of a liquid, e.g., water, which may be retained within the hollow cavity and in intimate contact with the chemical treatment composition. Such contact permits for the formation of a lavatory treatment composition in situ within the device, which is formed by the dilution, dissolution, diffusion, elution and/or solubilization of at least one or more chemical compounds from the chemical treatment composition which is at least partially or wholly immersed within liquid, or water contained within the device between flush cycles, namely the liquid present within the hollow cavity of the device below the inlet of the siphon means. The retention of water in intimate contact with the chemical treatment composition between flush cycles also allows for the formation of the lavatory treatment composition. Upon the actuation of the refill device of the lavatory appliance, when a quantity of water is supplied to the interior of the lavatory dispensing device via its inlet, water flows into the hollow cavity and forces the lavatory treatment composition outwardly through the outlet of the lavatory treatment device. During the refilling of the tank or cistern, the refill device acts to continuously provide a quantity of water which passes via the inlet of the device and into the hollow cavity where it comes into contact with at least one chemical treatment composition and forms an effective lavatory treatment composition which flows outwardly through the outlet ending to the overflow tube and into the sump of the toilet bowl during the operation of the refill device. In certain embodiments of the invention, namely wherein not all of the lavatory treatment is removed form the device via the outlet or the siphon means, the at least part of the water provided through the inlet retained within the interior of the hollow cavity and in contact with a chemical treatment composition, wherein it forms a further quantity of a lavatory treatment composition which will be released upon the next flush cycle of the toilet. This quantity or volume of the lavatory treatment composition is within the hollow cavity of the device at a point below the inlet of the siphon means. Concurrently any quantity or volume of a treatment composition within the hollow cavity of the device, which is present within the device but present within a region of the hollow cavity but vertically above the inlet of the siphon means is drained, or transferred out from the interior of the device to the exterior of the device via the siphon means and advantageously the outlet of the siphon means is directed to supply said lavatory treatment composition into the interior of the overflow tube from whence it passes to the sump of the toilet bowl. This foregoing process repeats itself continuously upon each flush cycle until the chemical treatment composition or compositions present within the device is or are fully exhausted or consumed. According to this embodiment of the invention, it is contemplated that the device can contain an upper part and the lower part of the hollow cavity separated by a divider means or element which can for example be a mesh, screen, perforated plate, membrane or any other element or material which permits for the flow of liquids such as water but especially the flow of lavatory treatment composition between the upper and lower parts of the device. Concurrently, in this embodiment the inlet of the siphon means is advantageously positioned at a level vertically above, or approximately coincident with the base of the upper part such that, between flush cycles, any liquid, especially lavatory treatment composition contained within the hollow cavity of the device is drained from the upper part of the device, but a further volume of liquid which may be present in the lower part of the hollow cavity is retained within the hollow cavity of the device between flush cycles. In this manner, two (or more) chemical treatment compositions can be provided within the hollow cavity of the device, one being positioned vertically above the other within the upper part, the other being retained within the lower part of the hollow cavity.

In a further embodiment of the invention, there is provided a device similar to that as described immediately above, wherein however the hollow cavity of the device is divided into at least an upper part which contains at least one chemical treatment composition, and a lower part which is empty of any chemical treatment composition and which lower part functions as a collection basin of the device. According to this embodiment, it is preferred that the inlet of the siphon means is present within, but preferably coincident with the lowest point of this collection basin, but may be above, and the upper part and lower parts are separated by a porous element or member, such as a screen, perforated plate, membrane, and the like. In such an embodiment, a quantity of the chemical treatment composition is retained in the upper part of the hollow cavity, during the flush cycle is washed with liquid, preferably water, and due to contact therewith forms a lavatory treatment composition but upon the cessation of the supply of water into the device, the volume of the liquid contained within both the upper part and lower parts of the device, especially a lavatory treatment composition, is transferred or drained therefrom by virtue of the siphon means. The siphon means can have an outlet which is within the interior of the overflow tube, or the placement of the outlet of the siphon means can direct the supply of lavatory treatment composition to any other point as may be desired, e.g. into the tank or cistern. Such an embodiment can be used with one or more chemical treatment compositions present within the hollow cavity. Advantageously according to the instant embodiment, any chemical treatment composition present within the upper part of hollow cavity of the device are allowed to at least partially dry between flush cycles with the use of a device according to this embodiment.

In a yet further embodiment of the invention, there is provided a device which comprises two abutting or adjoining chambers contained within, or forming the hollow cavity of device according to the invention wherein a vertical divider wall or other element is present which separates a least a portion of the hollow cavity into a first containment chamber, and at least a second containment chamber. At least a first chemical treatment composition can be contained within the first containment chamber, at least a second chemical treatment composition can be contained within the second containment chamber. Such a device according to the invention also necessarily includes at least one, but may include more than one siphon means which are fluid communications with at least the first containment chamber or the at least second containment chamber or both, which at least one siphon means are also in fluid communication with one or more points exterior of the device, or alternately are in fluid communication with an outlet of the device. The vertical divider wall or other element present may be arranged such that a liquid, such as water provided via the inlet of the device is divided into two separate streams, a first passing into the first containment chamber, and the second passing into the second containment chamber, forms, by virtue of contact with the respective chemical treatment compositions contained within separate chambers, lavatory treatment compositions which are kept separate from one another until there delivered outwardly from the device, such as into the interior of an overflow tube or to some other point in the laboratory appliance, e.g. the interior of the tank or cistern. The inclusion of a siphon means in fluid communication with one, or with both of these containment chambers allows for the prolonged or delayed delivery of a lavatory treatment composition in according to the manner described above.

Alternately, the vertical divider wall or other element present may be arranged such that a liquid, such as water provided via an inlet of the device passes into a first of the containment chambers where contacts a first chemical treatment composition, and thereby forms a first lavatory treatment composition which then sequentially flows into the second of the containment chambers wherein it contacts the second chemical treatment composition and thereby forms a further lavatory treatment composition which may then be directed via an outlet and thus exit the device. The inclusion of at least one siphon means in fluid communication with at least one of the containment chambers permits for either the partial, or complete drainage or transfer of any liquid contained within one or both of the containment chambers to the exterior of the device subsequent to the cessation of the supply of water into the interior of the device, such as via the refill means. In accordance with such an embodiment, the first laboratory treatment composition contacts the second chemical composition to form the final laboratory treatment composition which may be advantageous where a chemical reaction is expected to occur due to this sequential contact. Alternately or in addition thereto, in accordance with such an embodiment, a chemical treatment composition which would otherwise be considered unsuitable for use as being too soft, too soluble in the liquid, especially water, or which would be considered subject to premature erosion or solubilization could be used in such a device were a siphon means are provided in fluid communication with the containment chamber containing said chemical treatment composition. Including such a siphon means would provide for the drainage, preferably essentially complete drainage of any liquid treatment composition contained within the containment chamber between flush cycles and allow said chemical treatment composition to a least partially dry and thereby reduce its undesirably rapid dissolution and prolong its useful service life.

The inventors have found that desirably, at least a minimum volumetric ratio or volumetric proportion between the chemical treatment composition present within the interior of the device, particularly within the hollow cavity, and the quantity of water which is retained within the hollow cavity and in contact with the chemical treatment composition preferably be maintained in order to ensure the delivery of an effective lavatory treatment composition to the sump of the toilet (or other lavatory appliance) during the flush cycle. In accordance with preferred embodiments of the invention, the water passing through the inlet and into the interior of the hollow cavity enters the hollow cavity at a point above the quantity of a chemical treatment composition present and is not required to pass this mass or body of the chemical treatment composition before exiting via the outlet of the device. Rather, the flow of water passes into the filled volume of the cavity within the interior of the device. This filled volume is as the maximum quantity of the liquid, namely water, which may be contained within the interior of the lavatory treatment device when it is appropriately mounted upon an overflow tube, and any flow outward from any siphon means is blocked. Typically, this filled volume corresponds to the volume of the hollow cavity which exists between the base of the device and extends upward towards the top of the device to the level of the base of the outlet of the lavatory treatment device. This filled volume can be readily determined by mounting the lavatory treatment device onto an overflow tube in its normal operating position, and filling the hollow cavity up to the point with liquid in an amount sufficient to fill the bottom part of the hollow cavity but not in amount wherein said liquid flows out through the outlet of the device. As will be appreciated, this bottom part of the hollow cavity defines the maximum volume of water which can be contained within the lavatory treatment device, while the upper part of the cavity defines the headspace of the hollow cavity which is open to the ambient atmosphere within the interior of the cistern before, during, and after a flush cycle of the toilet. In preferred embodiments, the respective volumetric ratio between the chemical treatment composition, and the water which may be retained within the interior of a hollow cavity wherein both are simultaneously present is at least 1:2 and preferably is at least 1:1. The inventors of found that an insufficient respective volumetric ratio between the chemical treatment composition and the static water may result in the formation of an insufficiently effective lavatory treatment composition which is released and later retained within the sump of the toilet bowl. Such is particularly true wherein a sanitizing benefit is intended to be provided to the toilet bowl.

It is to be appreciated that during its operation, the interior volume of the device, that is to say the total interior volume of the inlet, hollow cavity, and outlet are not sufficiently sealed so to be pressurized by the flow of water being provided by the overflow conduit. Rather, both the force of gravity, as well as the dynamic flow force of the liquid, e.g., water, are the motive forces in the directional flow of the liquid being supplied to the device is essentially in a downward direction. Thus, the device does not require pressure-tight seals or pressure-tight connections in order to ensure its reliable operation, such as might be required if the flow of water from the overflow conduit were to be used to provide a pressurized, upward flow through the device. Furthermore, as the device is essentially unpressurized and as the connection between the outlet of the overflow conduit and the inlet to the lavatory treatment device taught herein are not via a pressure tight seal or pressure tight connection or fitting, should any unexpected and undesirable blockage or failure of the lavatory treatment device occur, such as by a blockage which would interrupt flow between the inlet and the outlet of the lavatory treatment device, then water exiting the overflow conduit would merely flow and overflow the inlet to the lavatory treatment device and into the cistern. Such provides a "fail-save" mode of operation. Such is particularly advantageous as, according to preferred embodiments, the open end of the inlet of the lavatory treatment devices taught herein are above the maximum water level of water contained within the cistern and, preferably are generally at least 1 centimeter, preferably at least 2 cm, still more preferably at least about 3 cm above the open end of the overflow tube when the device is mounted thereon.

Optionally but preferably the device according to the invention may additionally include an air treatment element. For example, such may be a reservoir comprising a quantity of an air treatment composition and/or fragrance composition which may form part of or be used with the lavatory treatment device. Exemplary air treatment constituents include a material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit. Exemplary fragrance compositions include naturally derived or synthetically produced chemical compounds and chemical species, such as essential oils, derivatives thereof, and synthetically produced chemical compounds which may be used singly but are more frequently used as blends or mixtures. The air treatment element may include a reservoir can take any shape or suitable form, and can be included within the interior of the device, or on the exterior of the device, or may be even be separate from the device but provided as a separate article or element which is separate or separable from the device but intended to be placed in the near proximity of the device, e.g. attached to another part of the toilet or lavatory appliance or nearby to the toilet or lavatory appliance. An air treatment element may include carrier or substrate for the air treatment composition or fragrance composition which may be a porous material such as a pad or tablet which is impregnated with, or upon which is absorbed a volatile composition useful in providing an air treatment benefit, a gel or a solid composition which also contains a volatile air treatment composition which may emanate from the air treatment element and/or reservoir. Alternately the air treatment element and/or reservoir may contain a quantity of a particulate material in the form of a single body, e.g. plate, or as a plurality of spheres, or beads which function as a reservoir for an air treatment composition and/or fragrance composition, and from whence they may be delivered to the ambient environment. Non-limiting examples of such materials include those currently marketed under the tradename Auracell® (ex. Rotuba Extruders) which are based on fragranced cellulosic polymers, as well as Poly-IFF® (ex. International Flavors and Fragrances Inc.), as well as Tenite® (ex. Eastman Chemical Co.). It is contemplated that part of the device may be formed of one or more of the foregoing materials, particularly one or more which may be injection molded to form part of the housing of the device. The air treatment element may be used to provide an air treatment composition and/or a fragrance composition to the ambient environment of the device, e.g., within the interior of the tank or cistern, or to the near proximity of the lavatory appliance with which the device of the invention is mounted or used.

The lavatory dispensing device whether formed from a single unitary piece or assembled from a plurality of discrete pieces or elements may be formed from any of a variety of materials which can be used for the purpose described herein. Exemplary and preferred materials include metals such as coated papers which are at least for a time essentially impervious to water, metal sheets or metal foils, non-metallic materials any of a number of thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Preferably the material of construction is at least somewhat flexible. As to the material of construction of the lavatory dispensing device, the only criteria being that the selected materials used to fabricate device are not deleteriously affected by the chemical constituents of the chemical composition contained within device or the lavatory treatment compositions forums using the device, and that they are impervious to water. Is appreciated that is too more different materials of construction can be used to form the to retrieve and devices according to the invention.

The dispensing devices according to the invention necessarily also comprise a chemical treatment composition comprising at least one or more chemical constituents such that when the chemical treatment composition is rinsed or washed with water, one or more chemical compounds or chemical constituents are eluted from a mass of the chemical treatment composition and dispersed or dissolved into said water and thereby forms a treatment composition which is useful in treating a sanitary appliance, particularly a toilet bowl. The treatment composition advantageously provides a cleaning and/or sanitizing benefit to the treated sanitary appliance.

The chemical treatment composition of the invention may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the chemical treatment compositions of the invention.

In certain embodiments, the chemical treatment composition of the invention desirably comprises a surfactant constituent which may be one or more detersive surfactants, especially one or more surfactants selected from: anionic surfactants, nonionic surfactants, cationic surfactants, zwitterionic surfactants and amphoteric surfactants.

Exemplary useful anionic surfactants are alpha olefin sulfonates, as well as salts thereof, e.g., alkali metal salts. Preferred are $C_8$ through $C_{22}$ alpha olefin sulfonates, particularly $C_{12}$ through $C_{18}$, and especially $C_{14}$, and $C_{16}$ alpha olefin sulfonates as well as blends of two or more thereof.

Exemplary useful nonionic surfactants include polyalkylene oxide condensates of alkyl phenols, condensation products of aliphatic alcohols with an alkylene oxide, especially an ethylene oxide, especially primary and secondary linear and branched alcohol ethoxylates, nonionic surfactants containing alkylene oxide, especially in which the major portion of the molecule is made up of block polymeric $C_2$-$C_4$ alkylene oxides, alkoxylated alkanolamides, preferably $C_8$-$C_{24}$ alkyl di($C_2$-$C_3$ alkanol amides), as well as amine oxides.

Exemplary useful cationic surfactants include those which provide a germicidal effect to the concentrate compositions, and especially preferred are quaternary ammonium compounds and salts thereof, which may be characterized by the general

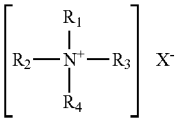

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary amphoteric and zwitterionic surfactants include alkylbetaines, especially amidoalkylbetaines, and sarcosinates.

The chemical treatment compositions may include one or more sanitizing agents or germicides, including one or more of those known to those of ordinary skill in the relevant art, and without limitation, alkyl halohydantoins, alkali metal haloisocyanurates, bleach, essential oils, non-quaternary ammonium based germicidal compounds as well as quaternary ammonium germicidal compounds.

The chemical treatment composition may also include compounds or constituents which on contact with water, releases oxygen, hypohalite or a halogen and especially chlorine. Representative examples of typical oxygen-release bleaching agents, suitable for incorporation in the chemical treatment composition include the alkali metal perborates, e.g., sodium perborate, and alkali metal monopersulfates, e.g., sodium monopersulfates, potassium monopersulfate, alkali metal monoperphosphates, e.g., disodium monoperphosphate and dipotassium monoperphosphate, as well as other conventional bleaching agents capable of liberating hypohalite, e.g., hypo chlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-mono-chlorocyanuric acid and N-monobromo-N,N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloro-imides, such as N-brominated and N-chlorinated succinimide, malonimide, phthalimide and naphthalimide.

The chemical treatment compositions may also include halohydantoins which may be represented by the general structure:

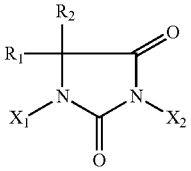

wherein:

$X_1$ and $X_2$ are independently hydrogen, chlorine or bromine; and, $R_1$ and $R_2$ are independently alkyl groups having from 1 to 6 carbon atoms. Examples of halohydantoins include, for example, N,N'-dichloro-dimethyl-hydantoin, N-bromo-N-chloro-dimethyl-hydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5,-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. Other suitable organic hypohalite liberating bleaching agents include halogenated melamines such as tribromomelamine and trichloromelamine. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the inventive chemical treatment composition and the treatment blocks formed therefrom.

When present, preferably the bleach constituent is a hypohalite liberating compound and more preferably is a hypohalite liberating compound in the form of a solid complex or hydrate thereof. Particularly preferred are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocynanurate complex. The most preferred chlorine bleach material is sodium dichloroisocyanurate.

When present, the bleach constituent may be present in any effective amount and may comprise up to about 90% wt., preferably at least about 0.01-100% wt of the chemical treatment composition.

Other germicidally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function; these have been described above with reference to detersive surfactants.

As a further chemical constituent, the chemical treatment compositions of the invention may also comprise a coloring agent which imparts either a color to chemical treatment compositions and/or to the water in which it comes into contact, but especially the coloring agent imparts a color to the water contained within the toilet bowl particularly following the flush cycle of a toilet. Colorants, especially dyes, are preferred when formulated as dry powders to enable direct incorporation into chemical treatment compositions of the invention, however, liquid colorants may be employed in conjunction with suitable carriers. When a bleach constituent is included in the chemical treatment composition, the colorant, e.g., dye, should be selected so to ensure the compatibility of the colorant with the bleach constituent, or so that its color persists despite the presence in the toilet bowl of a concentration of hypochlorite which is effective to maintain sanitary conditions.

The chemical treatment compositions may also include a fragrance or other air treatment constituent. The fragrance may be any composition which is known to the art to provide a perceptible fragrancing benefit, any may be based on naturally occurring materials such as one or more essential oils, or may be based on synthetically produced compounds as well. Exemplary air treatment constituents include a material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard.

As further chemical constituents, the chemical treatment compositions of the invention may comprise an anti-limescale agent, which can be generally classified as a cleaning agent in that it provides a cleaning effect to treated lavatory device surfaces. The anti-limescale agent can virtually any known anti-limescale agent compositions known to those of ordinary skill in the relevant art, e.g., amidosulfonic acid, bisulfate salts, organic acids, sulfonic, and sulfamic acids and their salts, bisulfate salts, organic phosphoric salts, alkali metal polyphosphates, EDTA, and the like. Examples of anti-limescale agent compositions can be found in, for example, U.S. Pat. Nos. 5,759,974; 4,460,490; and 4578207, the contents of which are herein incorporated by reference.

The chemical treatment compositions may comprise stain inhibiting materials, such as a manganese stain inhibiting agent, such as a partially hydrolyzed polyacrylamide having a molecular weight of about 2000 to about 10,000, a polyacrylate with a molecular weight of about 2000 to about 10,000, and/or copolymers of ethylene and maleic acid anhydride with a molecular weight of from about 20,000 to about 100,000.

The chemical treatment compositions of the invention may include one or more preservatives, which are primarily included to reduce the growth of undesired microorganisms within the chemical treatment compositions during storage prior to use or while used, although it is expected that the such a preservative may impart a beneficial antimicrobial effect to the water in the sanitary appliance to which the treatment block is provided. Exemplary useful preservatives include compositions which include parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. Examples of commercially available preservatives which may be used include KATHON® CG/ICP and KATHON® CG/ICP II (ex. Rohm and Haas) PROXEL® (ex. Zeneca Biocides) SUTTOCIDE® A (ex. Sutton Laboratories) as well as TEXTAMER® 38AD (ex. Calgon Corp.)

The chemical treatment compositions may include a binder constituent, particularly when the chemical treatment composition is formed into a solid or sem-solid mass such as a cake, tablet, block, briquette, densified powder, prill, or other configuration. The binder may function in part controlling the rate of dissolution of the tablet. The binder constituent may be a clay, or a water-soluble or water-dispersible gel-forming organic polymer, examples of which include chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose, naturally derived or manufactured (fermented) polymeric materials such as alginates and carageenan, as well as water-soluble starches and gelatin. The optional binder constituent may also be one or more synthetic polymers e.g, polyvinyl alcohols; water-soluble partially hydrolyzed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; as well as carboxypolymethylenes.

The chemical treatment composition may optionally include one or more dissolution control agents, which are materials which provide a degree of hydrophobicity to a treatment block formed from the chemical treatment composition. The inclusion of a dissolution control agent in treatment block or other mass formed from a chemical treatment composition contributes to the slow uniform dissolution of the treatment block when contacted with water, and simultaneously the controlled release of the active constituents of the chemical treatment composition. Exemplary dissolution control agents are mono- or di-alkanol amides derived from $C_8$-$C_{16}$ fatty acids, especially $C_{12}$-$C_{14}$ fatty acids having a $C_2$-$C_6$ monoamine or diamine moiety. The chemical treatment compositions may optionally include one or more water-softening agents or one or more chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof. The chemical treatment composition may optionally include one or more solid water-soluble acids or acid-release agents such as sulfamic acid, citric acid or sodium hydrogen sulfate.

The chemical treatment composition may include diluent materials to provide additional bulk of the product chemical treatment composition and may enhance leaching out of the surfactant constituent when the chemical treatment composition is placed in water. Exemplary diluent materials include any soluble inorganic alkali, alkaline earth metal salt or hydrate thereof, for example, chlorides such as sodium chloride, magnesium chloride and the like, carbonates and bicarbonates such as sodium carbonate, sodium bicarbonate and the like, sulfates such as magnesium sulfate, copper sulfate, sodium sulfate, zinc sulfate and the like, borax, borates such as sodium borate and the like, as well as others known to the art but not particularly recited herein.

The chemical treatment composition and blocks or other masses formed therefrom may include one or more fillers. Such fillers are typically particulate solid water-insoluble materials which may be based on inorganic materials such as talc or silica, particulate organic polymeric materials such as finely comminuted water insoluble synthetic polymers.

The chemical treatment composition and treatment blocks formed therefrom may include one or more further processing aids such as binders or plasticizers serving to assist in the manufacture thereof, for example, polypropylene glycol, pine oil fractions, d-limonene, dipentene and the ethylene oxide-propylene oxide block copolymers. Other useful processing aids include tabletting lubricants such as metallic stearates, stearic acid, paraffin oils or waxes or sodium borate which facilitate in the formation of the treatment blocks in a tabletting press or die. Further useful processing aids include certain diester constituents, as disclosed in published US patent application US 2007-0092477 A1, the contents of which are herein incorporated by reference in its entirety. Certain hydrocarbon solvents are also useful as processing aids and may form part of the chemical treatment compositions of the device according to the invention. Exemplary hydrocarbon solvents include those disclosed in published US patent application 2007/0003500 A1 the contents of which are incorporated by reference in its entirety. Mineral oil is may also be advantageously used as a processing aid.

An exemplary and preferred lavatory treatment composition is a compressed solid block of a chemical treatment composition commercially available as (ex. Lonza) having the following composition:

98% wt. of a mixture of 3-Bromo-1-Chloro-5,5-dimethylhydantoin, bromochloro-5,5-dimethylhydantoin, 1,3-dichloro-5,5-dimethylhydantoin, 1,3-dichloro-5-ethyl-5-methylhydantoin 1.5% wt. sodium chloride 0.5% wt. moisture.

The chemical treatment compositions may be provided in any of a number of forms. In certain preferred embodiments the chemical treatment composition may be provided in the form of at tablet or cake which is formed by extrusion and/or tabletting of the chemical treatment composition into suitably sized tablets, cakes, bricks, briquettes, blocks, prills, pearls, or alternately the chemical treatment compositions may be formed in situ within the devices of the invention, for example by providing a molten or flowable quantity of the chemical treatment composition to the hollow cavity of the device and permitting it to set or hard within the cavity, e.g. by cooling, where it forms a mass of the chemical treatment composition.

Ideally the chemical treatment composition exhibit a density greater than that of water which ensures that they will sink when suspended in a body of water, e.g., the water present within the hollow cavity.

While the mass of the chemical treatment compositions formed from the chemical treatment compositions may vary, and amount of up to an including 500 grams may be practiced, generally the mass of the chemical treatment compositions do not exceed about 250 grams. Advantageously the mass of the chemical treatment compositions is between about 50 and 150 grams. It is appreciated that chemical treatment compositions having great mass should provide a longer useful service life of the lavatory dispensing devices, with the converse being equally true.

The chemical treatment compositions according to the present invention may also be provided with a coating of a water-soluble film, such as polyvinyl acetate following the formation of the treatment blocks from the recited chemical treatment composition. Such may be desired for improved handling, however such is often unnecessary as preferred embodiments of the blocks exhibit a lower likelihood of sticking to one another following manufacture than many prior art treatment block compositions.

It will be appreciated by those of ordinary skill in the art that several of the components which are directed to provide a chemical composition can be blended into one chemical composition with the additional appreciation that potential blending of incompatible components will be avoided. For example, those of ordinary skill in the art will appreciate that certain anionic surfactants may have to be avoided as some may be incompatible with certain sanitizing agents and/or certain anti-lime scale agents mentioned herein. Those of ordinary skill in the art will appreciate that the compatibility of the anionic surfactant and the various sanitizing and anti-limescale agents can be easily determined and thus incompatibility can be avoided in the situations.

The chemical treatment compositions may be formed of a single chemical treatment composition, or may formed of two (or more) different chemical treatment composition which may be provided as separate regions of a solid block, such as a first layer of a solid block consisting of a first chemical treatment composition, alongside a second layer of a second chemical treatment composition which is different than the first chemical treatment composition, such a solid block may also be formed of two or more separate blocks which are simply layered or otherwise assembled, without or without the use of an adhesive. Further layers of still further different chemical compositions may also be present. Such chemical treatment compositions formed having two or more discrete layers or regions of, respectively, two or more different chemical compositions or different chemical treatment compositions may be referred to as composite blocks.

The chemical treatment composition may be a block may also be formed of two or more separate blocks which are simply layered or otherwise assembled, without or without the use of an adhesive. Alternately the solid block may be physically separated from one another such as by a plate or other physical barrier element forming part of the hanger, or more simply, by providing a simple gap between two masses or bodies of lavatory block compositions when they are applied to, or supplied to a hanger. Such latter embodiments provide a technique for using two chemically incompatible chemical treatment compositions as parts of a single dispensing device according to the invention.

Any form of the chemical treatment compositions may also be provided with a coating film or coating layer, such as a water soluble film which is used to overwrap the chemical composition provided in the device which film provides a vapor barrier when dry, but which dissolves when contacted with water. Alternately the chemical treatment compositions may be oversprayed or dipped into a bath of a water soluble film forming constituent, and thereafter removed and thus allowing the water soluble film forming constituent to dry and form a coating layer on the solid block.

The application of a water soluble film or coating is preferred in certain embodiments of the invention as the surface film may facilitate the handling of the blocks during packaging and storage prior to use of the dispensing devices described herein.

The service life of the lavatory treatment devices of the invention are preferably from about 10 to about 30 days, based on approximately 12 flushes per day. Preferably the service life of the chemical treatment compositions present within the lavatory treatment devices is at least about 21 days when the device is installed in the overflow tube in the cistern, or tank, of a lavatory device, especially a toilet. Preferably the temperature of the water which is flushed is in the range of 16-24° C. The length of service life of the lavatory dispensing device of the invention will of course depend on a variety of factors including the specific formulation of the chemical treatment composition which it contains, water temperature, the number and frequency of flushes over the period of use and the volume of the water which contacts the chemical treatment compositions within the lavatory dispensing device.

Various configurations of dispensing devices according to the present invention, including certain particularly preferred embodiments, are depicted on the following figures. In the accompanying figures, like elements are indicated using the same numerals throughout the figures.

Figure 1:
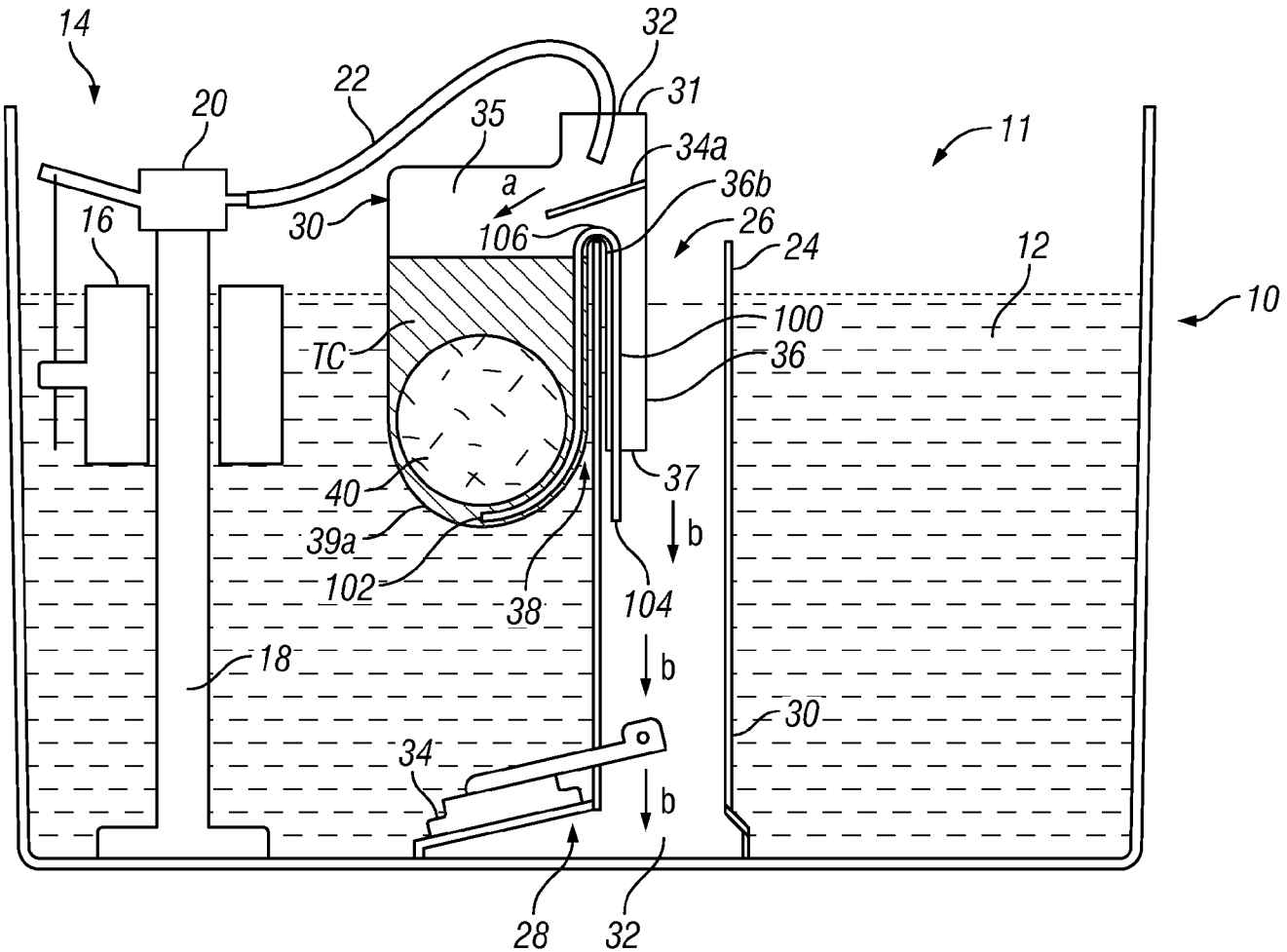

FIG. 1 depicts in a cross sectional view a toilet cistern (toilet tank). As is seen therein, the cistern 10 is a vessel adapted for a containing a quantity of water 12 which is used to flush a toilet bowl or other sanitary appliance which is attached to the toilet cistern 10. Interior of the cistern 10 is provided a refill device 14 which comprises a float 16 an inlet tube 18 and a cut off device 20 which operates to permit the inflow of water from an outside source into the interior 11 of the cistern 10. The cut off device 20 also operates to permit or to deny the delivery of water through an overflow conduit 22 which exits the refill device 14 via the overflow conduit 22, here depicted as a flexible tube, into the inlet 32 of the depicted lavatory dispensing device 30. As is visible from FIG. 1 and as is well recognized in the art, the overflow tube 24 has a top end 26 open to the interior 11 of the cistern 10 and at the opposite end thereof is second bottom end 30 in a mating, liquid tight connection to a flush valve 28. This bottom end 30 of the overflow tube 24 is typically connected to a portion of the body of the flush valve 28 by a liquid tight connection whereby that passage of the cistern water 12 is denied, (except when a failure of the refill apparatus 14 occurs). As is seen, the bottom open end 30 is in fluid communication with the interior cavity 32 of the flush valve 28 such that, as is readily appreciated any water flowing into the upper open end 26 of the overflow tube 24 falls downwardly through the bottom open end 30, past the flap valve 34 and downwardly through the open cavity 32 wherein it ultimately passes to the bowl of a toilet or of a sanitary appliance (not shown).

As has been discussed previously in specification, during a flush cycle, the majority of the water 12 present in the tank cistern 10 is released by displacement in an upward direction of the flap valve 34 whereby, due to the difference in hydrostatic pressure, the bulk of the water 12 is suddenly released into the flush valve 28 where it flows outwardly from the cistern 10 and downwardly and into a toilet (or other sanitary appliance similarly configured). This concurrently causes the float 16 to fall downwardly and as the water 12 exits the cistern, the refill device 14 operates to admit water in order to reinstate the prior level of water within the cistern 10. As the flush cycle, that is to say the release of the bulk of the water 12 from the cistern 10 by opening the flap valve 34 is quite rapid and typically is on the order of the less than approximately 30 seconds, typically less than 20 seconds, a relatively small amount of water is often admitted by the refill device 14 during the time that the flap valve 34 is open. After the release of most of the water 12, the flap valve 34 closes under the influence of gravity and such signals the conclusion of the release phase of the flush cycle, and indicates the initiation of the refill phase of the flush cycle wherein water being admitted into the cistern 10 via the refill device 14 begins refilling of the cistern 10. The operation of the refill device typically divides the quantity, that is to say the volumetric quantity, of water entering into a major portion which is normally directed into the interior of the cistern 10 so that it can be rapidly refilled, and a minor portion being diverted through the overflow conduit 22. Such diversion and division of the volumetric quantity being admitted is purposeful in that at or near the end of the release phase of the flush cycle, as the sump of toilet is emptied by virtue of the flushing water 12, it is desirable to refill the level of water in the toilet sump (not shown) and this is readily done by admitting a stream of water during the refill phase via the overflow conduit 22 into the overflow tube 24 where it flows downwardly and ultimately refills the sump of the toilet bowl or sump of other lavatory device. Water is admitted into the interior of the cistern 10 as well as through the overflow conduit 22 until the level of the float 16 rises and cuts of the supply of water, at which time all supply of water to the cistern 10 ceases. Such ceases the supply of water to the overflow conduit 22 and the overflow tube 24, and also signals the end of the refill phase of the flush cycle as well as the end of a flush cycle.

Thus, it is readily understood that water enters the overflow tube only intermittently during the operation of the lavatory device, namely only during a flush cycle. Therefore, the positioning and use of the lavatory dispensing device taught herein intermediate the overflow conduit and the overflow tube directs the water provided from the overflow conduit 22 into the interior of the device 30, and provides for the formation of a the lavatory treatment composition and delivering the same to the toilet bowl via the overflow tube 24. The inclusion of the siphon means associated with the device 30 permits for removal, e.g., transfer, draining of the lavatory treatment composition from with in the interior of the device 30 to its exterior, and advantageously into the overflow tube 24 wherein it may be directed to the toilet bowl while the flush valve 34 is closed. The lavatory treatment composition may be partially, or essentially fully removed from the interior of the device 30, thereby permitting for a chemical treatment composition to at least partially dry until the next flush cycle.

During the refill phase of a flush cycle, the flow of water being admitted via the overflow conduit 22 enters via the open end 31 of the inlet 32 of the lavatory dispensing device 30, wherein it is diverted by a diverter plate 34*a* in the direction indicated by arrow "a", causing the water to enter into the hollow cavity 35 wherein it comes into contact with a chemical treatment composition, here in the form of a compressed cylindrical tablet 40, wherein the water dissolves, elutes or entrains part of the compressed cylindrical tablet 40 which the water contacts and thus forms the lavatory treatment composition which flows out of the hollow cavity 35 into the interior of the overflow tube 24 wherein the lavatory treatment composition flows downwardly through the outlet 36 of the lavatory treatment device 30 and exits the same through the open end 37 of the outlet 36 in the direction indicated by arrows "b" through the overflow tube 24 and is provided directly into the sump of the toilet or other sanitary appliance. This chemical treatment composition may be a cleaning composition and/or a sanitizing composition, or any other composition which provides a treatment benefit to the toilet or other sanitary appliance. Thus, by virtue of the sequence of timed events, the delivery of a lavatory treatment composition is provided to the sump of a toilet bowl or other sanitary appliance at a particularly beneficial point in the flush cycle, namely during the refill phase of the flush cycle as well as subsequently which thus provides that the resultant lavatory treatment composition may be resident in the sump of the toilet bowl between uses of the toilet or sanitary appliance, more specifically between flush cycles.

FIG. 1 depicts a cross-sectional view a preferred mode of placement of the dispensing device according the invention with respect of the overflow tube 24. As is seen in the cross sectional view provided, the lavatory dispensing device 30 is wholly suspended upon the open top end 26 of the overflow tube 24 by a gap 38 present between the outlet 36 and the base 39*a* of the device 30, such that at least a part of the overflow tube 24 and especially its outlet 36 is within the interior of the overflow tube 24 and the outlet 37 is directed downwardly in a direction away from the open end 26 of the overflow tube 24. In this cross sectional view is also visible the interior of the device 30, including the filled volume of the device which corresponds to the volume of the hollow cavity 35 which exists between the base 39*a* of the device and extends upward towards the top of the device to the level of the top of the outlet 36*b* of the lavatory treatment device. Such also defines a "saddle" between the hollow cavity 35 and extending downwardly to the base 39*a* thereof, and the outlet 36 herein in the form of a hollow, downwardly extending "leg" of the device 30. Also visible it that the quantity of the lavatory treatment composition TC within the base 39*a* and defining the fill level is physically isolated from the bulk of the water 12 present in the cistern 10. Further visible is a siphon means, 100, here visible as a shaped hollow conduit having a first open end 102, viz., an inlet end, and extending upwardly from within the hollow cavity 35 and near or abutting the base 39*a* to a bend 106 which is above the level of the top 39*b* of the outlet 36, and then returns in a downward direction such that it extends outward of the device 30 wherein it terminates at a second open end 104, viz, an outlet end. In the depicted embodiment, the siphon means 100 is positioned to be within the interior of the device 30, with only a small section of the siphon means 100 extending outward of the outlet 37. In the preferred embodiment as illustrated, with respect to vertical orientation the second open end 104, is positioned at a level below the first open end 102 to ensure that approximately all (<95%) of the volume of the lavatory treatment composition is removed from the hollow cavity 35 and transferred to the interior of the overflow tube 24. Such however is not an absolute requirement and in other embodiments it is contemplated that the relative vertical displacement of the first open end 102 with respect to the second open end 104 of the siphon means 100 may be such that said second open end 104 is higher than or above that of the first open end 102 whereby the amount of any treatment composition which may be removed from the interior of the hollow cavity 35 of the device may be less than approximately all. The converse is also true, especially wherein the first open end 102 may be at a position upwardly from the base 39*a* of the device, and the second open end 104 may be at a position below that of the first open end 102, and optionally even below that of the base 39*a*. In such a configuration, the siphon means 100 would operate to remove lavatory treatment composition present in the device 30 only to the vertical level of the first open end 102, allowing for any lavatory treatment composition (or other liquid) present within the hollow cavity 35 above the base 39*a* but below the level of the first open end 102 to remain within the hollow cavity between flush cycles.

Importantly the provision of the siphon means 100 provides for the removal of a quantity of the lavatory treatment composition to occur during, but primarily following the conclusion of the flush cycle. Such permits for the at least partial drainage of the lavatory treatment composition TC to be removed or drained from the device 30, and depending upon the configuration of the device and its associated siphon means, such may introduce a time delay, that is to say, permit for the prolonged or delayed delivery of a lavatory treatment composition after delivery of water via the overflow conduit 22 has ceased at the end of the refill cycle of the toilet. Such a time delay is particularly advantageous as, following cessation of the delivery of water via the overflow conduit 22 has ceased, water flowing into the interior of the overflow tube 24 also ceases and such permits for the subsequent delivery of a lavatory treatment composition still present within the hollow cavity 35 of the interior of the device 30 to be removed via the siphon means 100 and delivered into the overflow tube 24 without additional dilution with water from the overflow conduit 22.

While not illustrated, a retention means may also be provided for use with the device 30, or may form part of the device 30, such as one or more springs, or leaf springs which are at least partially elastic and which may be present in the linear gap 38 to provide improved retention of the device 30 when it is installed in the manner depicted. FIG. 1 depicts the preferred mode of installation and use of the preferred embodiments of the present invention in all manner and forms as described in the following figures, although it is recognized that alternative methods of supplying the dispensing device of the invention within an overflow tube may also be practiced.

Turning now to FIGS. 2A, 2B, 2C and 2D therein is depicted in greater detail in a cross sectional view a preferred embodiment of a dispensing device fully according to the present invention, which is similar in most respects with that depicted on FIG. 1, illustrated as mounted on an overflow tube 24. These figures also illustrate the sequence of process steps which are practiced using the device 30 according to the invention.

Figure 2A:
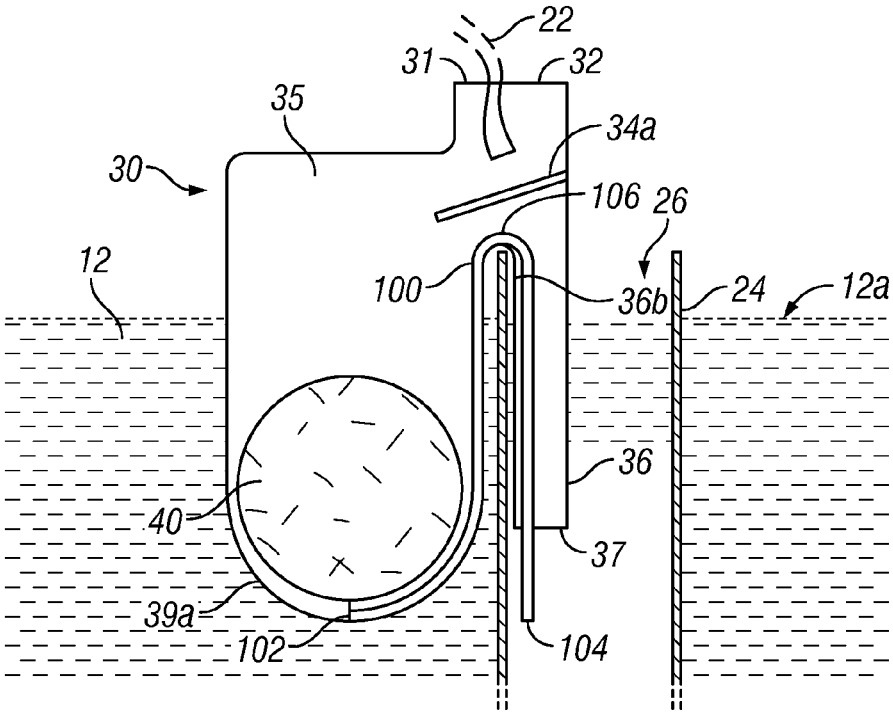

FIG. 2A illustrates the device 30 mounted on a part of an overflow tube 24 within the interior of a toilet tank 10, immediately prior to a flush cycle. As visible thereon, the device 30 includes a hollow cavity 35 containing a chemical treatment composition resting near the base 39*a* of the device, an inlet 32, a diverter plate 34*a* within the interior of the device 30, and an outlet 36, extending into the interior of the overflow tube 24 such that the open end 37 of the outlet 36 is also within the interior of the overflow tube 24. The device 30 further includes a siphon means 100 having a first open end 102 at or near the base 39*a* of the device 100, which extends upwardly via a bend 106 and then extends downwardly and continues within the interior of the outlet 36 where it terminates at a second open end 104 which is also within the interior of the overflow tube 24. As is also visible thereon, the hollow cavity contains the chemical treatment composition 40 in the form a tablet or block, but is essentially free of any liquid, especially of any lavatory treatment composition. The tank contains water 12, having a top surface 12*a* or level which is vertically positioned beneath the open end 26 of the overflow tube 24.

Figure 2B:
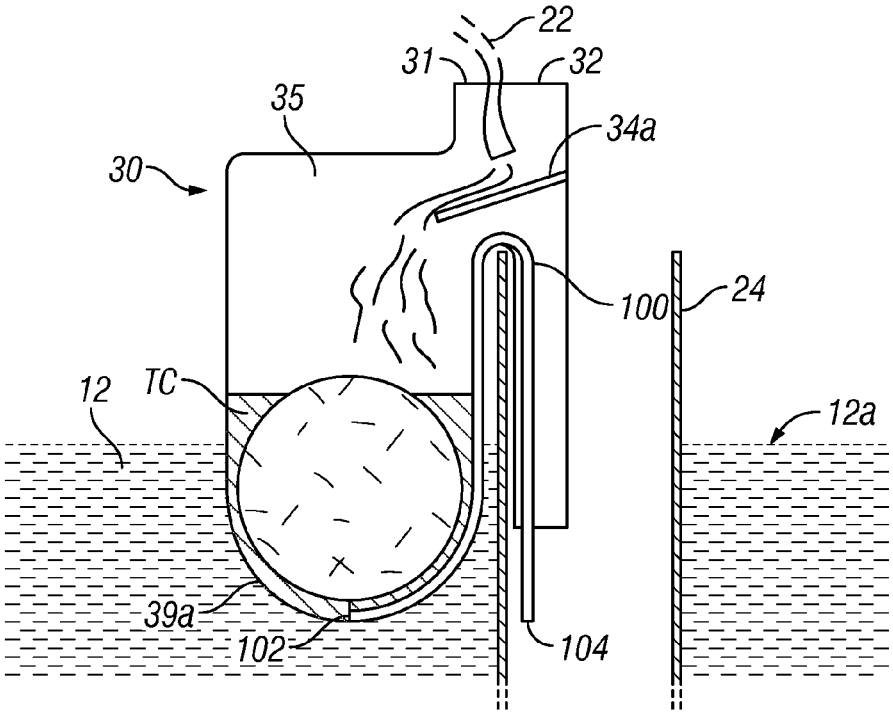

FIG. 2B illustrates a next sequential state of the device 30 according to the invention at a time just subsequent to the beginning of a flush cycle. As may be seen from the figure, water 22 is supplied via the overflow conduit 22 via the opening 32 and into the hollow cavity 35 in the interior of the device 30. The water entering is diverted by the diverter plate 34*a* where it contacts the chemical treatment composition 40 and elutes or dilutes part of the same to form a lavatory treatment composition TC within the hollow cavity 35. At this point of the process and at this time, insufficient water has been supplied to the hollow cavity 35 to either initiate operation of the siphon means 100 and to cause flow of the treatment composition TC to flow outwardly from the device 30 via its outlet 36 and outlet opening 37 and thereafter into the overflow tube 24. Concurrently the volume of water in the tank decreases as it exits out past the flap valve 34 (not shown) and flush valve 28 (not shown) causing the level or top surface 12*a* of water within the tank to drop with respect to the open end 26 of the overflow tube 24.

Figure 2C:
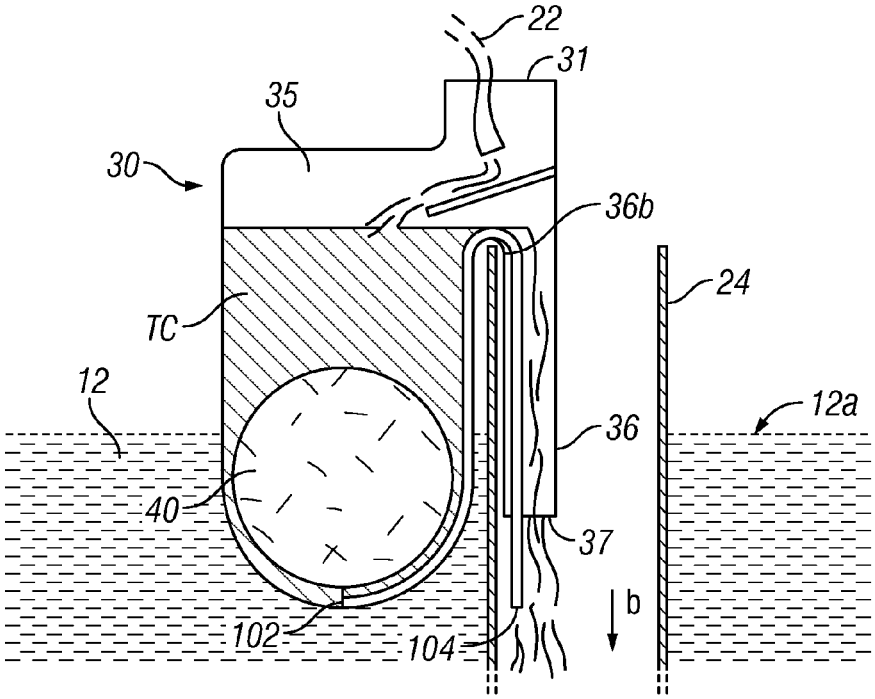

FIG. 2C illustrates a next sequential state of the device 30 according to the invention at a time subsequent to the beginning of a flush cycle and/or during the refill cycle. As illustrated in the figure, sufficient water has been supplied to the hollow cavity 35 via the overflow conduit 22 such that the lavatory treatment composition TC formed within the device 30 such that it flows over the top of the outlet 36*b* of the lavatory treatment device and downwardly through the outlet 36 and its open end 37 and into the overflow tube 37 in the direction of arrows "b". Optionally a quantity of the lavatory treatment composition TC may also flow through the siphon means 100 and exit it second open end 104 and into the interior of the overflow tube 24 as well.

Figure 2D:
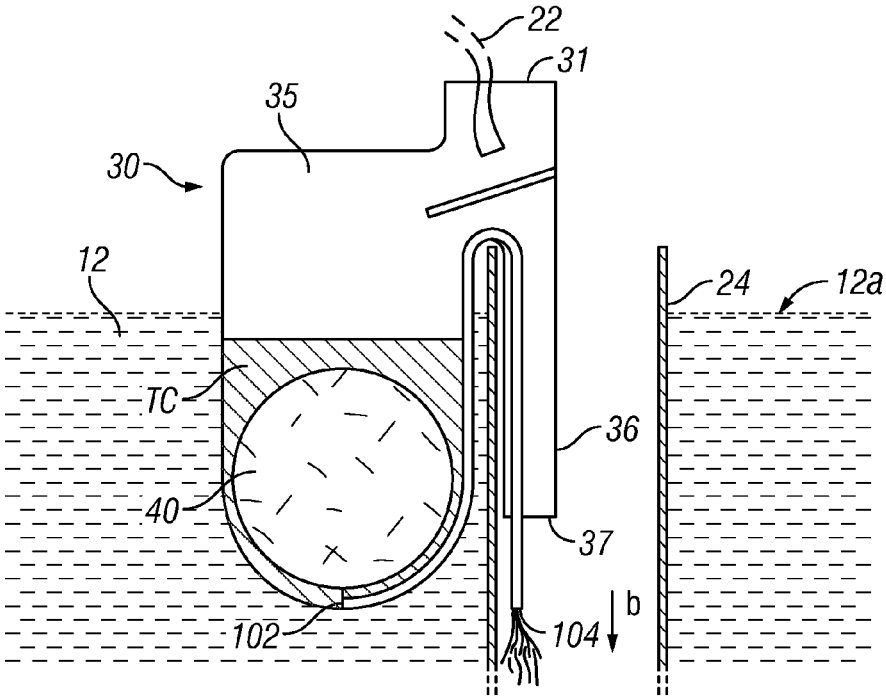

FIG. 2D illustrates a next sequential state of the device 30 according to the invention at a time subsequent the refill cycle. As visible thereon, water has ceased being supplied via the overflow conduit 22, and the treatment composition TC is being transferred outwardly from the device 30 solely by virtue of the siphon means 100. During this step in the process, treatment composition TC present in the hollow cavity 35 is withdrawn via the siphon effect and is delivered into the interior of the overflow tube 24 where it flows downwardly in the direction of arrow "b" from whence it will pass to the sump or interior of the toilet bowl. The lavatory treatment composition TC exits the siphon means 100 via the second open end 104 which is at a vertical position lower than the first open end 102 of the siphon means 100 which ideally will cause a substantial part (<90%, but preferably more), but preferably essentially all of (<95%, but preferably more) of the liquid volume of the lavatory treatment composition TC to be removed from the device prior to the next flush operation of the toilet, or within the next 30 minutes, whichever is longer. Such permits for both the prolonged delivery of a quantity of the lavatory treatment composition TC after the flush cycle and also permits for the chemical treatment composition 40 to at least partially dry.

Following the removal of the lavatory treatment composition TC in accordance with the manner described in the steps illustrated on FIGS. 2C and 2D, the device 30 returns to the status and condition as illustrated on FIG. 2A.

The process steps outlined above and discussed with reference to FIGS. 2A, 2B, 2C and 2D may be repeated indefinitely.

Figure 3:
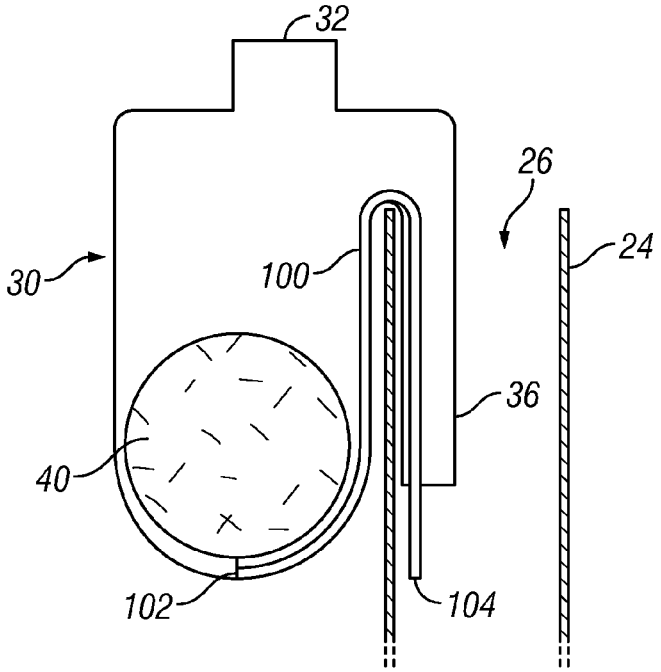
FIG. 3 depicts in a cross-sectional view a further embodiment of a dispensing device.

FIG. 3 depicts in a cross-sectional view a further embodiment of a device 30 according to the invention mounted upon a portion of an overflow tube 24. As is visible thereon, a siphon means 100 is positioned substantially within the interior of the device 30, with the second open end 104 extending downwardly within the interior 26 of the overflow tube 24 and, which second open end 104, viz, outlet, is at a point vertically lower than the first open end 102, viz., inlet, of the siphon means 100. The embodiment of FIG. 3 differs in several respects from the prior embodiments discussed namely: the inlet 32 was not vertically disposed above the outlet 36, but rather in the specific embodiment, is positioned vertically above the chemical treatment composition 40 and about the center thereof and, no diverter plate 34 is present as such is not necessary.

Figure 4:
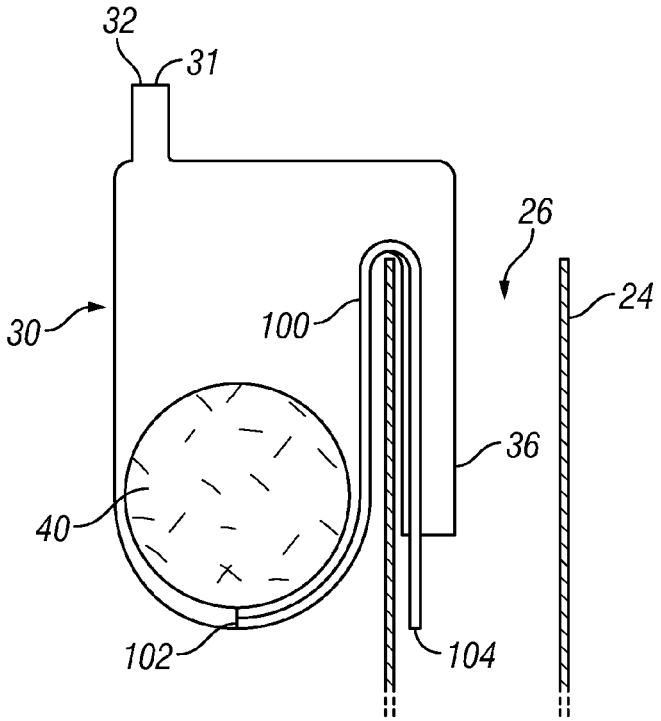
FIG. 4 illustrates in a cross-sectional view a different embodiment of a dispensing device.

FIG. 4 depicts a cross-sectional view a still further embodiment of a device 30 according to the invention, which is also mounted upon a portion of the overflow tube 24. The device 30 depicted on figure is its titular similar to that of prior FIG. 3 but differs still further into the inlet 32 is not placed vertically above the outlet 36 but rather, is positioned at the opposite side of the top of the device 30 away from the outlet 36. As is further visible on FIG. 4, the dimensions, that is to say a cross-sectional area of the inlet 32 is substantially narrower than that of bar depictions of the inlet 32. Such a feature may be desired where a narrowed inlet would be considered beneficial.

Figure 5:
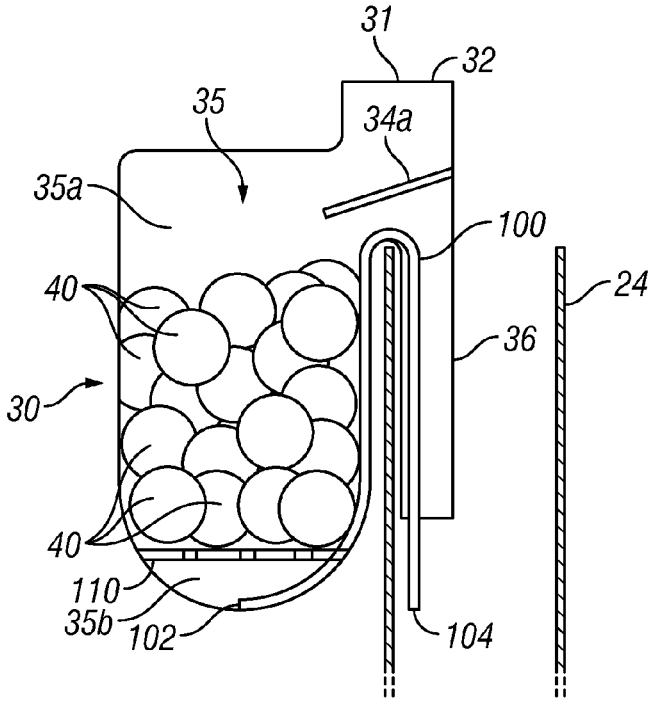
FIG. 5 depicts in a cross-sectional view a still further embodiment of a dispensing device.

FIG. 5 illustrates a still further embodiment of the device 30 according to the invention. The depicted embodiment is substantially similar to the embodiment discussed with reference to FIGS. 1, and 2A-2D, but includes several additional features. Namely the depicted embodiment includes a divider means 110 here in the form of a perforated plate which separates the hollow cavity 35 into an upper part 35*a* and a lower part 35*b*. The perforated plate permits for the flow of liquids so to permit for the flow of lavatory treatment composition between the upper part 35*a* and the lower part 35*b* of the device 30. Concurrently, in this embodiment the inlet 102, viz., the first open end of the siphon means 100 is advantageously positioned beneath the divider means 110 at or near the bottom of the bottom part 35*b* and of the hollow cavity 35 such that the siphon means 100 operates to remove or drain the lavatory treatment composition formed within the device 30. Further, the depicted embodiment illustrates a further form of the chemical treatment composition 40, which is here provided as a plurality of shaped bodies, e.g., spheres which are positioned in the upper part 35*a* of the hollow cavity 35 and separated from the lower part 35*b* by virtue of the divider means 110. In such an embodiment, the chemical treatment composition may at least partially dry between flush cycles. It is to be understood that while each of the plurality of shaped bodies representing chemical treatment composition 40 may be formed from the same chemical constituents, such is not a requirement and two or more different chemical compositions may be present.

Figure 6:
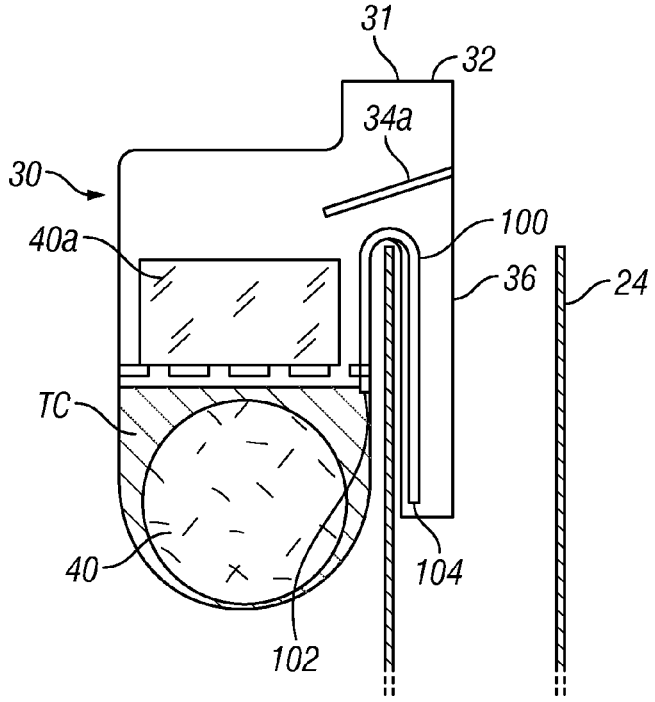
FIG. 6 illustrates in a cross-sectional view an alternative embodiment of a dispensing device.

FIG. 6 depicts in a cross-sectional view a yet further embodiment of the device 30 according to the invention. The depicted embodiment is substantially similar to the embodiment discussed with reference to FIGS. 1, 2A-2D, but includes several additional features. Embodiment according to FIG. 5 further includes a divider means 110 here in the form of a perforated plate which separates the hollow cavity 35 into an upper part 35*a* and a lower part 35*b*. The perforated plate permits for the flow of liquids so to permit for the flow of lavatory treatment composition between the upper part 35*a* and the lower part 35*b* of the device 30. Concurrently, in this embodiment the inlet 102, viz., the first open end of the siphon means 100 is advantageously positioned at a level vertically above, or approximately coincident with the divider means 110 such that, between flush cycles, any liquid, especially lavatory treatment composition contained within the upper part 35*a* hollow cavity 35 of the device may be drained from the upper part 35*a* of the device, but a further volume of liquid which may be present in the lower part 35*b* of the hollow cavity 35 is retained within the hollow cavity 35 of the device 30 between flush cycles. This further volume of liquid retained in the lower part 35*b* of the device 35 is retained in contact with the chemical treatment composition 40 also present in the lower part 35*b* of the device 30 and forms a lavatory treatment composition TC. The further chemical treatment composition 40*a* which is in the upper part 35*a* is supported by virtue of divider means 110 above the level of the further volume of liquid retained in the lower part 35*b* of the device 35 between flush cycles during which time it may at least partially dry. In this manner, two (or more) chemical treatment compositions can be provided within the hollow cavity of the device, one being positioned vertically above the other within the upper part, the other being retained within the lower part of the hollow cavity.

Figure 7:
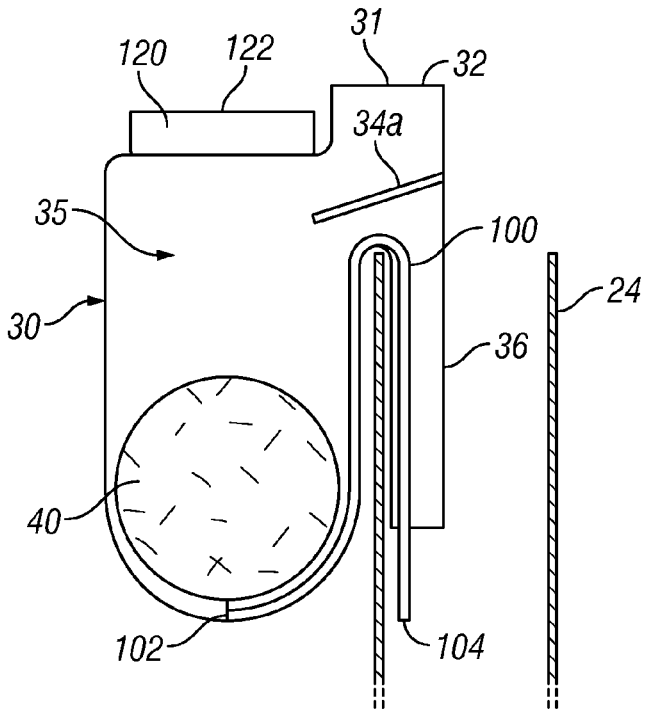
FIG. 7 illustrates in a cross-sectional view a yet further embodiment of a dispensing device.

FIG. 7 illustrates a cross-sectional view of a further embodiment of a device 30 according to the invention. The device 30 of FIG. 7 is substantially the same as the embodiments illustrated and discussed with reference to FIGS. 1, 2A, 2B, 2C and 2D but further includes an air treatment element 120. The depicted air treatment element 120 is a tray having an open top 122 which contains a carrier or substrate (not shown) for the air treatment composition or fragrance composition. The air treatment element 120 may be used to treat the airspace within the toilet tank, and/or the ambient environment of the toilet. Between flush cycles, the air treatment element 120 is particularly effective in delivering a fragrance and/or other air treatment composition to the surrounding air. It is believed that during the flush cycle, the passage of the water in the toilet tank induces the flow of the surrounding air containing the fragrance and/or other air treatment composition through the overflow tube and thereafter to the toilet bowl wherein a fragrance and/or other air treatment can be perceived by a consumer or user.

Figure 8:
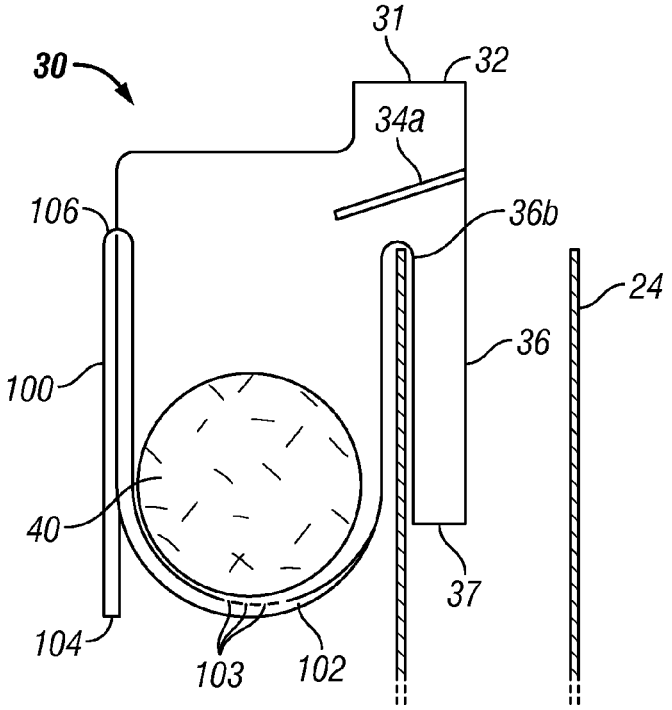
FIG. 8 depicts in a cross-sectional view a further embodiment of a dispensing device.

FIG. 8 illustrates a cross-sectional view of a further embodiment of a device 30 according to the invention. The device 30 of FIG. 8 is substantially the same as the embodiments illustrated and discussed with reference to FIGS. 1, 2A, 2B, 2C and 2D but differs in that the siphon means 100 is integrally formed as a part of the device 30, as opposed to the embodiments of FIGS. 1, 2A, 2B, 2C and 2D wherein the siphon means was a discrete element. As visible on FIG. 8, the siphon means 100 is formed as part of a sidewall of the device, and includes an inlet end 102 end which includes a plurality of perforations 103, an outlet end 104 and intermediate thereto, a bend 106 which is above the level of the top 39*b* of the outlet 36 of the device 30.

Figure 9:
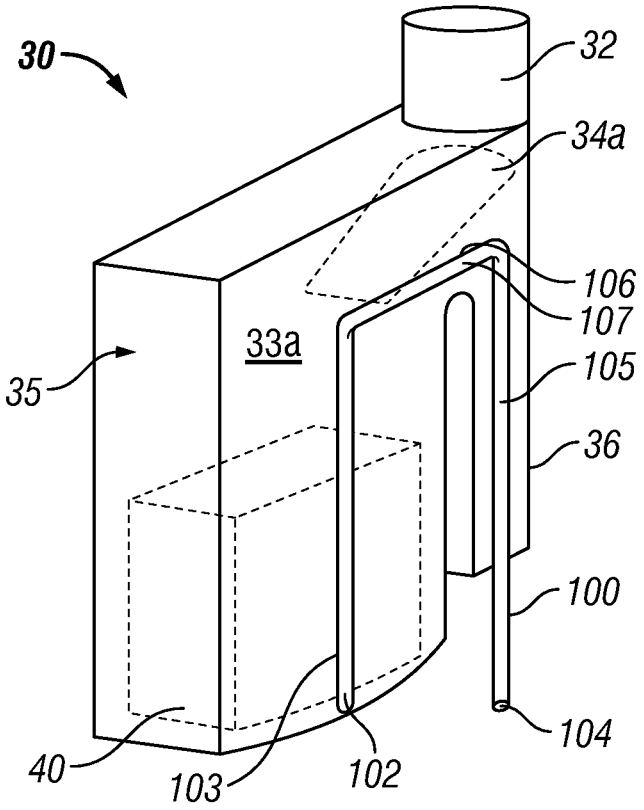
FIG. 9 depicts in a perspective view a further embodiment of a dispensing device.

FIG. 9 illustrates in a partial perspective view a further embodiment of a lavatory dispensing device 30 which is similar in many regards to the embodiments discussed previously and depicted on FIGS. 1, 2A-2D the which can be differentiated in that the siphon means 100 abuts the exterior of the device 30. as depicted, the siphon means 100 abuts an exterior sidewall 33*a* and comprises a first open end 102, viz., an inlet, and upwardly extending first leg 103 which extends to, and is in fluid communication with a transverse leg 107 which coincides with the bend 106 previously discussed, and which transverse leg 107 extends to, and his influence communication with a downwardly extending leg 105 which terminates at a second open and 104, viz., an outlet. The first open end 102 is in fluid communication with the interior 35 of the device 30, and thus may successfully draw a quantity of a treatment composition or other liquid from within said interior, while the opposite second open end 104 is position exterior of the device, and in the configuration is adapted to be inserted concurrently with the outlet 36 of the device 30 and into the interior of an overflow tube (not shown). According to the instant embodiment, the provision of a siphon means 100 in such a manner provides for an alternative method of fabrication of such a device 30, and also provides for a siphon means 100 which can be rigidly fixed or positioned relative to the device 30, and specifically relative to the exterior sidewall 33*a*.

FIGS. 10A and 10B illustrate two views of a further embodiment of a lavatory treatment device 30 according to the invention, the first being a partial plan view and the second a partial plan, partial sectional view Referring first to FIG. 10A, there is depicted a lavatory dispensing device 30 having an hollow cavity 35 which is partially divided into a first hollow cavity part 35*a* and as second hollow cavity part 35*b* by a divider means 60 here a wall contiguous with the bottom wall and two opposite sidewalls of the device 30. Present in the first hollow cavity part 35*a* is a first chemical treatment composition 40*a*, in the form of a cake or tablet which is kept separated from a second chemical treatment composition 40*b* also in the form of a cake or tablet present in the second hollow cavity part 35*b*. This relationship is also depicted in FIG. 4B. Such a form of the lavatory dispensing device 30 may be particularly useful wherein it is desired to form two lavatory treatment compositions which are respectively formed from the first chemical treatment composition 40*a* in the first hollow cavity part 35*a*, and the second chemical treatment composition 40*b* in the second hollow cavity part 35*b*. During a flush cycle, water entering the device 30 through the open end 31 of the inlet 32 forces water into the first hollow cavity part 35*a* and also the first lavatory treatment composition over the top end 60*a* of the divider means 60 wherein it spills into the second hollow cavity part 35*b* and contacts the second chemical treatment composition 40*b* present therein where it entrains or dissolves at least a part of, thus forming a second lavatory treatment composition. This ultimate lavatory treatment composition, viz., the second lavatory treatment composition exits out of the open end 37 of the outlet 36 into an overflow tube and then to a toilet bowl (both not shown in the figures). During the flush cycle, and especially during the refill cycle and preferably also following the conclusion of the refill cycle, this ultimate lavatory treatment composition is also delivered via the siphon means 100 to the overflow tube, and thereafter to the toilet bowl. In such a manner a prolonged delivery of the ultimate lavatory treatment composition can be provided. As the liquid contents of the second hollow cavity part 35*b* are removed via the siphon means 100, the second chemical treatment composition 40*b* is provided with an opportunity to at least partially dry prior to the next flush cycle of the toilet, while at the same time, liquid contained within the first hollow cavity part 35*a* can be retained up to the level of the top end 60*a* of the divider means 60, viz., the wall can be retained there between flush cycles and at least partially immerse the first chemical treatment composition 40*a* which may be advantageous particularly if such is the bleach containing block, war is a material which releases one or more chemical constituents having a sanitized and oriented microbial benefits. A time interval of partial immersion of said first chemical treatment composition 40*a* in these to form a more concentrated first lavatory treatment composition which may be beneficial in the treatment of a laboratory appliance specially toilet bowl.

In such an embodiment of the lavatory dispensing device 30, two chemically incompatible chemical treatment compositions and/or lavatory treatment compositions may be formed and kept physically isolated from one another until they are sequentially mixed during the flush cycle and only thereafter delivered. For example, such a device 30 may be used wherein the first chemical treatment composition 40*a* is a bleach block, and the second chemical treatment composition 40*b* is a block containing a colorant, e.g., a dye which would otherwise be bleached if kept in contact with the first lavatory treatment composition formed from the bleach block. As a further example, such a device 30 may be used wherein the first chemical treatment composition 40*a* is a bleach containing block, and the second chemical treatment composition 40*b* is a block containing one or more surfactants which can provide useful forming benefits. Use of the embodiment of the lavatory dispensing device 30 shown ensures that any contact with the bleach containing, first lavatory treatment composition formed from the bleach block, and the second, colorant containing, second lavatory treatment composition formed from the block containing a colorant is for only a few seconds prior to being delivered through the overflow tube 24 and thereafter into the toilet bowl. Such may permit for the delivery of a bleach containing, but colored lavatory treatment composition to a toilet bowl which may however lose its visual color over time, thus providing a visually discernible benefit.

As a further example, such a device 30 may be used wherein the first chemical treatment composition 40*a* is a bleach containing block, and the second chemical treatment composition 40*b* is a block containing one or more surfactants which can provide useful foaming benefits. The use of such an embodiment of the device 30 permits for the formation of the concentrated form of a first lavatory treatment composition due to the prolonged immersion or least partial immersion of the bleach containing block within a quantity of water contained within the first hollow cavity part 35*a*, while concurrently permitting for the second chemical treatment composition 40*b*, viz., a block containing one or more surfactants to at least partially dried between flush cycles. Such may be technically advantageous as tablets, blocks, or cakes containing a relatively high proportion of surfactants are known to quickly soften and frugally undesirably quickly degrade when immersed in water. The use of the device according to the instant embodiment permits for the brief contact of the first laboratory treatment composition with the second chemical treatment composition to occur during the flush cycle, but in the typically relatively longer time intervals between flush cycles, removal of a substantial amount of liquid from the second hollow cavity part 35*b* permits for the second chemical treatment composition 40*b* to at least partially dry, and thereby prolonging the useful service life of the device, and due to the prolonged delivery of the ultimate laboratory treatment composition via the siphon means 100, also deliver an aliquot of the ultimate laboratory treatment composition containing surfactants to the sump of a toilet bowl where it maybe visibly perceived by a consumer.

FIGS. 11A, 11B and 11C depict three views of a further embodiment of a lavatory treatment device 30 divided into a first hollow cavity part 35*a* and as second hollow cavity part 35*b* by a divider means, here a wall 60 contiguous with the bottom wall, and two opposite sidewalls and with the top of the device 30, such that the hollow cavity part 35 is completely divided. The divider means, here the wall 60 also extends into and divides the outlet 36 as well. Present in the first hollow cavity part 35*a* is a first chemical treatment composition 40*a*, in the form of a cake or tablet which is kept separated by the wall 60 from a second chemical treatment composition 40*b* also in the form of a cake or tablet present in the second hollow cavity part 35*b*. Means for dividing the flow of water into the device 30, namely a construction of the inlet 32 which includes two separate and preferably equally sized inlet orifices 32*a*, 32*b* which respectively provide water into the respective first hollow cavity part 35*a* and second hollow cavity part 35*b*. Such permits for the division of water flowing into the device 30, but continues to keep the first hollow cavity part 35*a* and second hollow cavity part 35*b* isolated from one another. The detail of this construction is more clearly visible in the partial top plan view of the inlet 32 provided by FIG. 1B. FIG. 11C depicts a cross sectional view of the device 30 along section line x1-x1 of FIG. 11A, as viewed toward the direction of the outlet 36. As is visible thereon, the first hollow cavity part 35*a* contains a first chemical treatment composition 40*a*, while the second hollow cavity part 35*b* contains a second chemical treatment composition 40*b*, here both in the form of tablets or cakes. Also visible are the respective inlet orifices 32*a* and 32*b*. Considering FIG. 11A and FIG. 11C, it is now better understood that in use, a first lavatory treatment composition formed by the contact of water and the first chemical treatment composition 40*a* present in the first hollow cavity part 35*a* exits the device via a first outlet 36*a* and through the open end 37*a* thereof, and concurrently a second lavatory treatment composition formed by the contact of water and the second chemical treatment composition 40*b* present in the second hollow cavity part 35*b* exits the device via a second outlet 36*b* and through the open end 37*b* thereof, wherein the stream of the first lavatory treatment composition and the stream of the second lavatory treatment composition first intermix. During the refill cycle, and preferably after the refill cycle of the toilet, the siphon means 100 removes quantities of the first lavatory treatment composition from the first hollow cavity part 35*a* via its inlet 102 and passes it out its outlet 104, thereby substantially draining the first lavatory treatment composition from the first hollow cavity part 35*a* and from the device 30 during the refill cycle and/or following the refill cycle. While not illustrated it is to be understood that the lavatory dispensing device 30 is mounted via its outlet element 36, here the combined first outlet 36*a* and second outlet 36*b*, on an overflow tube 34 in a manner hereintofore described, e.g. FIG. 1. Accordingly the present embodiment of FIGS. 11A-11C provide an embodiment wherein two separate lavatory treatment compositions are separately formed and maintained within the device 30 in a parallel type relationship, and only are mixed together to form an ultimate lavatory treatment composition after streams of the two separate lavatory treatment compositions exit the device 30 and intermix.

FIG. 12 illustrates in a cross-sectional view an embodiment of the device according to the invention wherein the outlet of the device operates as the siphon means, as well as the outlet of the device. The depicted embodiment is similar in many respects to the embodiments illustrated on FIGS. 1, 2, 3 and 4, but can be differentiated therefrom in that the siphon means 100 is integrally formed in the device 30 such that a part of the siphon means 100 takes the place of the outlet 36 of the lavatory treatment device 30, such that any treatment composition (not shown) present in the hollow cavity 35 ultimately flows via the siphon means 100 and is delivered to the interior 26 of the overflow tube 24 via the second open end 104 of the siphon means 100.

In the embodiment illustrated on FIG. 12, with respect to vertical orientation, the second open end 104, is positioned at a level below the first open end 102 to ensure that approximately all (<95%) of the volume of the lavatory treatment composition is removed from the hollow cavity 35 and transferred out of the device, here via the second open end 104 of the siphon means 100. Such however is not an absolute requirement and in other embodiments it is contemplated that the relative vertical displacement of the first open end 102 with respect to the second open end 104 of the siphon means 100 may be such that said second open end 104 is higher than or above that of the first open end 102 whereby the amount of any treatment composition which may be removed from the interior of the hollow cavity 35 of the device may be less than approximately all. The converse is also true, especially wherein the first open end 102 may be at a position upwardly from the base 39*a* of the device, and the second open end 104 may be at a position below that of the first open end 102, and optionally even below that of the base 39*a*. In such a configuration, the siphon means 100 would operate to remove lavatory treatment composition present in the device 30 only to the vertical level of the first open end 102, allowing for any lavatory treatment composition (or other liquid) present within the hollow cavity 35 above the base 39*a* but below the level of the first open end 102 to remain within the hollow cavity between flush cycles.

With regard to the foregoing embodiments described herein it is to be understood that part or elements of one embodiment can be substituted for a related part or elements in different embodiments illustrated on different figures.

It is also to be understood that where a single siphon means is described with reference to device, that a plurality of siphon means may be associated or provided with any embodiment of a device according to the invention.

It is to be understood that a lavatory dispensing device as disclosed herein may also have a different geometry, configuration or and appearance than the embodiments described in the Figures and still be considered to fall within the scope of the invention.

In a further aspect of the present invention there is also provided a process for delivering a treatment composition to a sanitary appliance, especially preferably, to the interior of a toilet bowl, and still more preferably to the sump of the toilet bowl or other sanitary appliance. This process includes the steps of: providing a lavatory dispensing device as described hereinabove to the cistern of a toilet or other lavatory appliance having an overflow tube wherein at least a part of the lavatory dispensing device is inserted in to the interior of the overflow tube, and, periodically supplying water through the lavatory treatment device in order to form a lavatory treatment composition with said water which lavatory treatment composition is used to treat a part of the sanitary appliance downstream of the overflow tube, preferably the interior of a toilet bowl, and via the use of a siphon means, transferring, removing or draining a quantity of a lavatory treatment composition from the device.

The foregoing process may be practiced to provide a cleaning treatment and/or a sanitizing or disinfecting treatment to the toilet bowl or a part thereof, or alternately to a part of a sanitary appliance.

Preferably the foregoing process is practiced such that at least 60%, preferably at least 70%, and more preferably at least 80% of the water provided to the overflow tube during a flush cycle is provided subsequent to the release of water from the cistern to the interior of the toilet bowl, particularly via a valve, whereby at least 60%, preferably at least 70%, and more preferably at least 80% of a lavatory treatment composition formed by contacting the at least one chemical treatment composition with water is provided to the toilet bowl or lavatory appliance following the closing of the valve during the flush cycle.

In order to further illustrate the present invention, various examples of preferred embodiments of the invention are described, following. In these examples, as well as throughout the balance of this specification and claims, all parts and percentages are by weight unless otherwise indicated.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A lavatory dispensing device which delivers at least one treatment composition to a toilet bowl which device comprises:

a non-pressurizable lavatory dispensing device comprising a hollow body having an inlet located along or at a top surface of the device which inlet is open to the ambient environment of the toilet, and an outlet also open to the ambient environment of the toilet in which it is installed, said hollow body defining an interior cavity which is adapted to contain a quantity of a chemical treatment composition as well as a quantity of water which is adapted to be provided to the interior of said hollow body via the inlet, and a siphon means having a first open end within the interior cavity, and a second open end within the outlet or exterior of the device, wherein the outlet of the device is in the form of a hollow, downwardly extending leg, wherein the leg is adapted to be inserted at least partially into the interior of an overflow tube present in the cistern of a toilet and whereby the dispensing device is wholly suspended upon the top open end of the overflow tube by a linear gap present between the outlet and the hollow body, and wherein a part of the siphon means is within and/or adjacent to the hollow cavity, and a further part of the siphon means extends within and/or is adjacent to the hollow, downwardly extending leg, and wherein the cross-sectional area of the second open end of the siphon means is less than the cross-sectional area of the outlet of the device.

2. A lavatory dispensing device according to claim 1 wherein said device is of a sealed construction and cannot be opened by a consumer or other user to access the interior cavity containing the quantity of the chemical treatment composition once the lavatory dispensing device is assembled.

3. A lavatory dispensing device according to claim 1 wherein the inlet and the outlet are both located at one side of the hollow body.

4. A lavatory dispensing device according to claim 1 wherein the device includes a flow diverter plate.

5. A lavatory dispensing device according to claim 1 wherein the siphon means is a discrete element.

6. A lavatory dispensing device according to claim 1 wherein both the inlet and the outlet are unobstructed by the chemical treatment composition present within the interior of the lavatory dispensing device.

7. A lavatory dispensing device according to claim 1 wherein the hollow cavity is a divided hollow cavity.

8. A lavatory dispensing device according to claim 1 wherein the chemical treatment composition is a cleaning composition or a sanitizing composition.

9. A lavatory dispensing device according to claim 1 wherein the chemical treatment composition is a cleaning composition and/or a sanitizing composition.

10. A process for delivering a treatment composition to the interior of a toilet bowl, which includes the steps of: providing a lavatory dispensing device according to claim 1 to the cistern of a toilet having an overflow tube wherein at least a part of the lavatory dispensing device is inserted in to the interior of the overflow tube, and, periodically supplying water through the lavatory treatment device in order to form a lavatory treatment composition with said water which lavatory treatment composition is used to treat a the interior of a toilet bowl.

11. A lavatory dispensing device according to claim 1, wherein the device further comprises a divider means separating the hollow cavity into an upper part, and a lower part, wherein a quantity of a first chemical treatment composition is contained in the upper part, and a quantity of a second chemical treatment composition is contained in the lower part.

12. A lavatory dispensing device according to claim 11, wherein the divider means is a perforated plate.

13. A lavatory dispensing device according to claim 11, wherein the first open end of the siphon means is positioned within the device at a level vertically above or approximately coincident with the divider means.

14. A lavatory dispensing device according to claim 1, wherein the siphon means is integrally formed a part of the device.

15. A lavatory dispensing device according to claim 1, wherein the hollow cavity of the device is partially divided by a wall which is contiguous with the bottom wall and with two opposite sidewalls of the device, which wall divides the hollow cavity into a first hollow cavity part and a second hollow cavity part, and wherein a quantity of a first chemical treatment composition is contained in the first hollow cavity part, and a quantity of a second chemical treatment composition is contained in the second hollow cavity part.

16. A lavatory dispensing device according to claim 15, wherein the first open end of the siphon means is positioned in the second hollow cavity part of the device.

17. A lavatory dispensing device according to claim 1, wherein the hollow cavity of the device is divided by a wall which is contiguous with the bottom wall, and two opposite sidewalls and with the top of the device, which wall divides the hollow cavity into a first hollow cavity part and a second hollow cavity part, and wherein a quantity of a first chemical treatment composition is contained in the first hollow cavity part, and a quantity of a second chemical treatment composition is contained in the second hollow cavity part.

* * * * *